US008316910B2

(12) United States Patent
Popa et al.

(10) Patent No.: US 8,316,910 B2
(45) Date of Patent: Nov. 27, 2012

(54) AWNING ASSEMBLIES

(75) Inventors: Gheorghe Popa, El Paso, TX (US); Eduardo Ornelas, El Paso, TX (US)

(73) Assignee: Dometic LLC, Elkhart, IN (US)

( * ) Notice: Subject to any disclaimer, the term of this patent is extended or adjusted under 35 U.S.C. 154(b) by 769 days.

(21) Appl. No.: 11/508,693

(22) Filed: Aug. 23, 2006
(Under 37 CFR 1.47)

(65) Prior Publication Data

US 2007/0193700 A1 Aug. 23, 2007

Related U.S. Application Data

(60) Provisional application No. 60/740,080, filed on Nov. 28, 2005.

(30) Foreign Application Priority Data

Aug. 26, 2005 (DE) ..... 10 2005 040 755
Aug. 26, 2005 (DE) ..... 10 2005 040 756
Aug. 26, 2005 (DE) ..... 20 2005 013 597 U

(51) Int. Cl.
*E04F 10/06* (2006.01)

(52) U.S. Cl. ..... 160/70; 160/46; 160/71

(58) Field of Classification Search ..... 160/46, 160/66, 67, 70, 71, 79, 80, 44, 81; 248/354.1, 248/354.4, 296.1, 291.1, 273, 280.11, 281.11, 248/276.1, 278.1, 279.1, 125.8, 188.5, 354.5; 138/88.11, 88.12; 16/241, 245; 403/58, 403/328, 109.3, 379.5; 410/145
See application file for complete search history.

(56) References Cited

U.S. PATENT DOCUMENTS 470,777 A * 3/1892 Billings ..... 30/162
1,350,400 A 8/1920 Yeomans
1,681,016 A 8/1928 Schmidt
(Continued)

FOREIGN PATENT DOCUMENTS

DE 2619175 11/1977
(Continued)

OTHER PUBLICATIONS

FIAMMA Awnings Operating Instructions, FIAMMA Inc., Oct. 2003, pp. 2-18.

(Continued)

*Primary Examiner* — Blair M. Johnson
(74) *Attorney, Agent, or Firm* — Pearne & Gordon LLP

(57) ABSTRACT

Awning assemblies include at least one arm assembly. In accordance with example aspects, the arm assembly can include a first segment, a second segment pivotally connected to the first segment and a biasing member extending between portions of the segments with the biasing member being substantially hidden within an area defined by the first and second segments in a closed orientation. In accordance with further example aspects, a biasing member can be provided to resist rotation of a link member with respect to a mounting bracket with an adjustment device configured to adjust the compression of the biasing member. In accordance with yet further examples, the awning assembly can include a support leg and a pivot assembly connecting the support leg to a lead rail. The pivot assembly can include a stop member to limit a pivoting movement of the pivot assembly. In further examples, the awning assembly can include first and second support legs that each include a locking device configured to selectively lock the support legs in one of a plurality of pre-determined incremental lengths.

16 Claims, 24 Drawing Sheets

U.S. PATENT DOCUMENTS 2,505,416 A * 4/1950 Mahaffey ..... 74/89.37
2,802,633 A * 8/1957 Moore ..... 248/179.1
3,356,329 A * 12/1967 Santo ..... 248/273
3,719,220 A 3/1973 Small
3,782,443 A * 1/1974 Clauss et al. ..... 160/22
3,834,400 A * 9/1974 Sattler ..... 135/88.12
3,854,517 A 12/1974 Nakamura
4,037,726 A * 7/1977 Schweers ..... 211/105.5
4,143,699 A * 3/1979 Marotto ..... 160/176.1 R
4,160,458 A * 7/1979 Marcellus ..... 160/67
4,200,135 A * 4/1980 Hennequin ..... 160/168.1 R
4,230,309 A * 10/1980 Schnitzius ..... 267/120
4,254,950 A * 3/1981 Baumann ..... 482/112
4,509,576 A * 4/1985 Giovanni ..... 160/66
4,566,516 A * 1/1986 Lohausen ..... 160/22
4,590,642 A * 5/1986 Hesener ..... 16/241
4,658,877 A * 4/1987 Quinn ..... 160/46
4,733,683 A 3/1988 Pozzi
4,823,720 A * 4/1989 Foster ..... 114/98
5,029,363 A * 7/1991 Hesener ..... 16/241
5,031,681 A * 7/1991 Dodich ..... 160/176.1 R
5,031,682 A 7/1991 Tedeschi
5,044,416 A * 9/1991 Murray ..... 160/22
5,119,867 A 6/1992 Lukos
5,135,453 A * 8/1992 Sollenberger ..... 482/101
5,172,743 A * 12/1992 Wallace et al. ..... 160/67
5,174,352 A 12/1992 Murray et al.
5,207,255 A * 5/1993 Shannon ..... 160/65
5,232,036 A * 8/1993 Brutsaert ..... 160/70
5,273,095 A * 12/1993 Lukos ..... 160/70
5,285,837 A 2/1994 Pozzi
5,292,169 A * 3/1994 O'Brian ..... 296/98
5,307,856 A * 5/1994 Murray ..... 160/70
5,314,390 A * 5/1994 Westing et al. ..... 482/6
5,365,989 A * 11/1994 Eger et al. ..... 160/22
5,369,919 A * 12/1994 Lohausen ..... 52/73
5,390,719 A * 2/1995 Barnes ..... 160/10
5,394,921 A * 3/1995 Lohausen ..... 160/22
5,437,298 A * 8/1995 Lin ..... 135/117
5,558,145 A * 9/1996 Baka ..... 160/67
5,562,143 A * 10/1996 Oberstadt ..... 160/70
5,615,725 A * 4/1997 Ming-Shun ..... 160/370.22
5,622,214 A * 4/1997 Baka et al. ..... 160/71
5,636,675 A * 6/1997 Baka et al. ..... 160/67
5,653,278 A * 8/1997 Cheng ..... 160/370.22
5,669,430 A * 9/1997 Malott ..... 160/67
5,752,560 A * 5/1998 Cherng ..... 160/370.22
5,832,978 A * 11/1998 Kroner ..... 160/79
5,848,629 A 12/1998 Baka
5,921,305 A * 7/1999 Grudl ..... 160/66
5,924,465 A * 7/1999 Malott ..... 160/67
5,934,350 A * 8/1999 Ciuca ..... 160/176.1 R
6,029,732 A 2/2000 Malott
6,056,350 A * 5/2000 Brutsaert ..... 296/163
6,095,221 A 8/2000 Frey, Jr.
6,098,693 A 8/2000 Frey, Jr.
6,131,638 A * 10/2000 Levin ..... 160/80
6,189,948 B1 * 2/2001 Lin ..... 296/97.4
6,216,762 B1 * 4/2001 Lin ..... 160/370.22
6,230,783 B1 5/2001 Frey, Jr.
6,260,908 B1 7/2001 Fraula et al.
6,273,172 B1 * 8/2001 Frey ..... 160/67
6,276,424 B1 8/2001 Frey, Jr.
6,341,638 B1 1/2002 Thompson et al.
6,363,664 B1 4/2002 Brutsaert
6,378,591 B1 4/2002 McCoy
6,484,069 B2 11/2002 Osinga
6,488,069 B1 * 12/2002 Mashaw et al. ..... 160/67
6,488,159 B2 * 12/2002 Shuen ..... 211/123
6,557,612 B2 5/2003 Voss
6,581,664 B2 * 6/2003 Kroner et al. ..... 160/70
D488,708 S * 4/2004 Lam et al. ..... D8/363
6,732,018 B2 * 5/2004 Osinga ..... 700/275
6,763,874 B1 * 7/2004 Chen ..... 160/370.22
6,874,558 B2 * 4/2005 Mester et al. ..... 160/22
6,904,826 B2 * 6/2005 Hesener ..... 74/483 R
6,971,433 B2 * 12/2005 Wagner et al. ..... 160/67
7,017,976 B1 * 3/2006 Rutherford et al. ..... 296/163
7,070,546 B1 * 7/2006 Grasso ..... 482/103
7,128,124 B2 * 10/2006 Bibby et al. ..... 160/263
7,163,042 B2 * 1/2007 Li ..... 160/22
7,213,869 B1 * 5/2007 McClellan ..... 296/161
7,338,411 B2 * 3/2008 Blacker ..... 482/33
7,369,672 B2 * 5/2008 Hirschhorn ..... 381/333
7,395,995 B2 * 7/2008 Chen ..... 248/284.1
7,451,797 B2 * 11/2008 Llagostera Forns ..... 160/79
7,481,408 B1 * 1/2009 Knight ..... 248/354.1
2002/0007922 A1 * 1/2002 Kroener et al. ..... 160/79
2002/0062851 A1 5/2002 Thompson et al.
2003/0094827 A1 5/2003 Faludy et al.
2005/0224191 A1 * 10/2005 Nien ..... 160/173 R
2008/0150465 A1 * 6/2008 Baba et al. ..... 318/568.12
2008/0277073 A1 * 11/2008 Ito ..... 160/67
2008/0308238 A1 * 12/2008 Ito ..... 160/67

FOREIGN PATENT DOCUMENTS

DE 3243025 5/1984
DE 9312924 3/1995
DE 29612961 10/1996
DE 19516419 11/1996
DE 29612532 11/1996
DE 19536134 4/1997
DE 19604535 8/1997
DE 19633249 3/1998
DE 19736852 3/1998
DE 19753138 6/1999
DE 19800397 7/1999
DE 10141957 3/2003
DE 102004017379 A1 8/2005
EP 0980787 2/2000
EP 0999319 5/2000
EP 1174565 1/2001
EP 1074675 2/2001
EP 1267011 12/2002
SE 9001579 * 11/1991
WO 9961721 12/1999

OTHER PUBLICATIONS

European Search Report for EP 06017644 dated Apr. 13, 2011.

* cited by examiner

AWNING ASSEMBLIES

CROSS-REFERENCE TO RELATED APPLICATION

The present invention claims the benefit of U.S. Provisional Application No. 60/740,080 filed Nov. 28, 2005, the entire disclosure which is herein incorporated by reference.

FIELD OF THE INVENTION

The present invention relates to awnings and more particularly to awning assemblies for mounting to a support structure.

BACKGROUND OF THE INVENTION

It is known to provide conventional awning assemblies for buildings or vehicles. For instance, it is known to provide a recreational vehicle with an awning assembly. Such conventional awning assemblies are typically mounted on an upper portion of the wall and above the side door of a recreational vehicle. Conventional awning assemblies have proven beneficial for a variety of purposes. For instance, conventional awning assemblies have proven beneficial to shelter an area next to a recreational vehicle by shielding the area from rain. In further examples, conventional awning assemblies have proven effective to shelter an area from direct sunlight. There is a need for awning assemblies for mounting to a support structure to provide shelter to an area adjacent a support structure.

SUMMARY OF THE INVENTION

It is an aspect of the present invention to provide awning assemblies for mounting to a support structure.

In accordance with one aspect, an awning assembly includes at least one arm assembly including a first segment and a second segment pivotally connected to the first segment. The at least one arm assembly further includes a biasing member extending between portions of the first and second segments. The first and second segments are configured to pivot relative to one another between an open orientation with the biasing member being exposed and a closed orientation with the biasing member being substantially hidden within an area defined by the first and second segments.

In accordance with another aspect, an awning assembly for mounting to a support structure is provided. The awning assembly includes an arm assembly, a mounting bracket configured to mount to a support structure and a link member pivotally attached between the arm assembly and the mounting bracket. The arm assembly is configured to pivot with respect to the link member about a first pivot axis and the link member is configured to pivot with respect to the mounting bracket about a second pivot axis. The awning assembly further includes a biasing member configured to resist rotation of the link member with respect to the mounting bracket about the second pivot axis and an adjustment device configured to adjust the compression of the biasing member.

In accordance with still another aspect, an awning assembly for mounting to a support structure comprises an arm assembly including a first end portion and a second end portion, wherein the first end portion is configured for mounting with respect to a support structure. The awning assembly further includes a lead rail mounted with respect to the second end portion of the arm assembly, wherein the arm assembly is configured to support the lead rail with respect to a support structure. The awning assembly further includes a support leg and a pivot assembly connecting the support leg to the lead rail. The pivot assembly includes a pivot bracket attached to the lead rail and a pivot arm pivotally attached to the support leg to permit the support leg to pivot about a first axis extending in a first direction. The pivot assembly further includes a pivot link pivotally attaching the pivot arm to the pivot bracket. The pivot arm is configured to pivot with respect to the pivot link about a second axis extending in a second direction that is substantially perpendicular to the first direction. The pivot link is further configured to pivot with respect to the pivot bracket about a third axis extending in a third direction that is substantially perpendicular to the first direction and the second direction. The pivot assembly further includes a first stop member configured to limit the extent to which the pivot link can pivot with respect to the pivot bracket.

In accordance with yet another aspect, an awning assembly for mounting to a support structure comprises an arm assembly including a first end portion and a second end portion, wherein the first end portion is configured for mounting with respect to a support structure. The awning assembly further includes a lead rail mounted with respect to the second end portion of the arm assembly, wherein the arm assembly is configured to support the lead rail with respect to a support structure. The awning assembly further includes a support leg and a pivot assembly connecting the support leg to the lead rail. The pivot assembly includes a pivot bracket attached to the lead rail and a pivot arm pivotally attached to the support leg to permit the support leg to pivot about a first axis extending in a first direction. The pivot assembly further includes a pivot link pivotally attaching the pivot arm to the pivot bracket. The pivot arm is configured to pivot with respect to the pivot link about a second axis extending in a second direction that is substantially perpendicular to the first direction. The pivot link is further configured to pivot with respect to the pivot bracket about a third axis extending in a third direction that is substantially perpendicular to the first direction and the second direction. The pivot assembly further includes a stop member configured to limit the extent to which the pivot arm can pivot with respect to the pivot link.

In accordance with still another aspect, an awning assembly for mounting to a support structure is provided. The awning assembly includes an arm assembly with a first end portion and a second end portion, wherein the first end portion is configured for mounting with respect to a support structure. The awning assembly further includes a lead rail mounted with respect to the second end portion of the arm assembly, wherein the arm assembly is configured to support the lead rail with respect to a support structure. The awning assembly still further includes a first and second support leg that each include a first segment attached to the lead rail, a second segment attached to the first segment, and a locking device configured to selectively lock the second segment with respect to the first segment in a selected one of a plurality of alternate relative positions to allow the support legs to be selectively locked in one of a plurality of predetermined incremental lengths.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION OF EXAMPLE EMBODIMENTS

Figure 1:
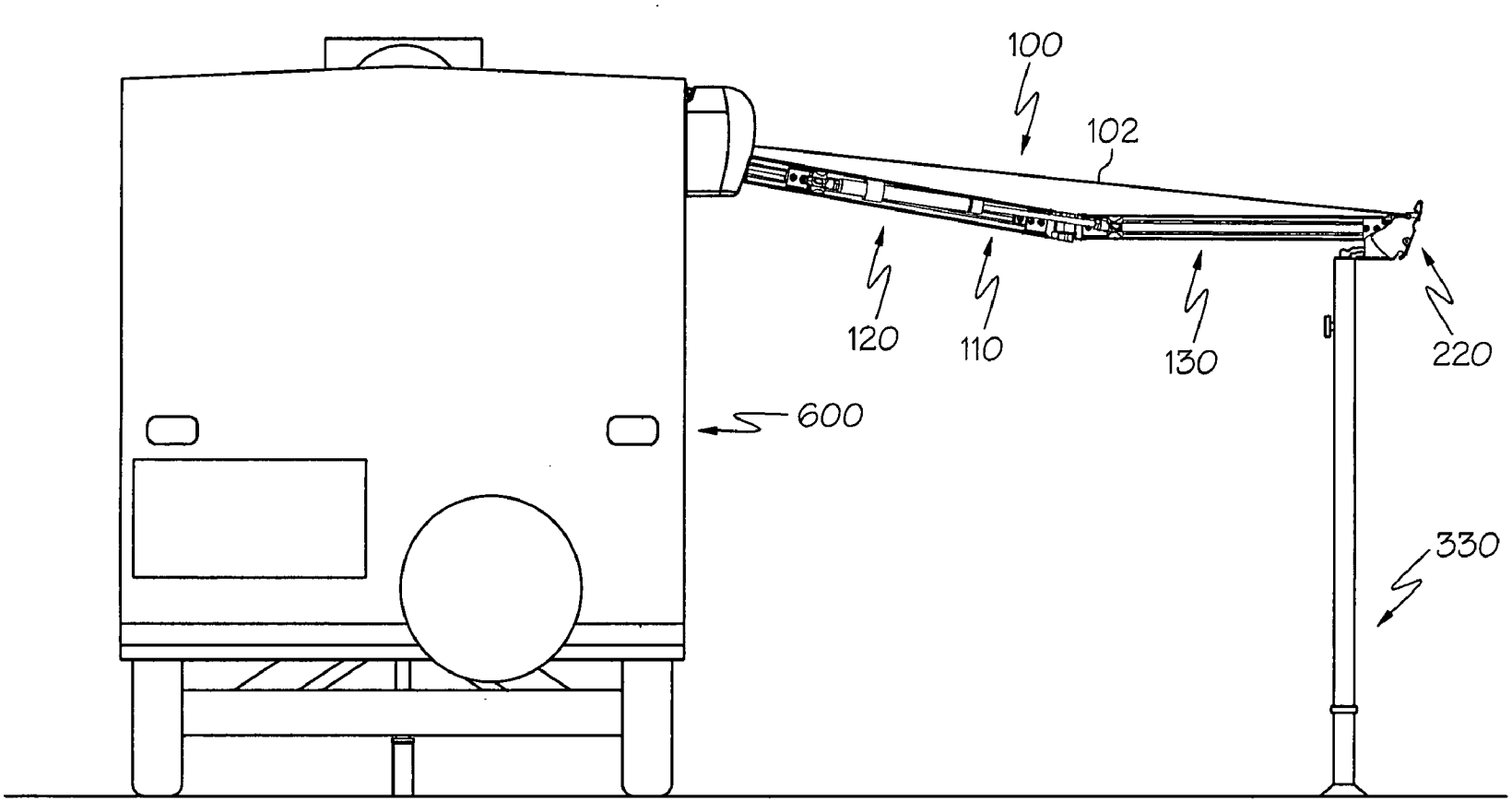
FIG. 1 is a side view of an awning assembly mounted to a support structure incorporating aspects of the present invention.

Certain terminology is used herein for convenience only and is not to be taken as a limitation on the present invention. Further, in the drawings, the same reference numerals are employed for designating the same elements.

FIG. 1 depicts an awning assembly 100 for mounting to a support structure. Awning assemblies herein may be mounted to a wide range of support structures such as a vertical surface (e.g., a wall of a building, a wall of a mobile unit, a doorway or the like). In further examples, the support surface may comprise surfaces other than vertical surfaces (e.g., a ceiling, roof structure, etc.) or other support surfaces. In the illustrated example, the awning assembly 100 is shown mounted to a support structure 600 comprising a vertical wall of a recreational vehicle although other support structures may be provided in further examples. Awning assemblies herein may be used to shelter an area from falling debris, weather (e.g., sun, precipitation) and/or may be incorporated as part of an enclosure to inhibit contact with pests such as mosquitoes or the like.

The illustrated awning assembly 100 incorporates a variety of aspects of the present invention that may be used individually or in combination with one another. For instance, as shown, the awning assembly 100 can comprise at least one arm assembly 110 including a first segment 120 and a second segment 130 pivotally connected to the first segment. The first and second segments can comprise similar or different constructions with similar or different lengths depending on the particular application. As shown, the segments 120, 130 comprise linear segments although it is contemplated that the segments may be curved or have other shapes in different examples.

Figure 10:
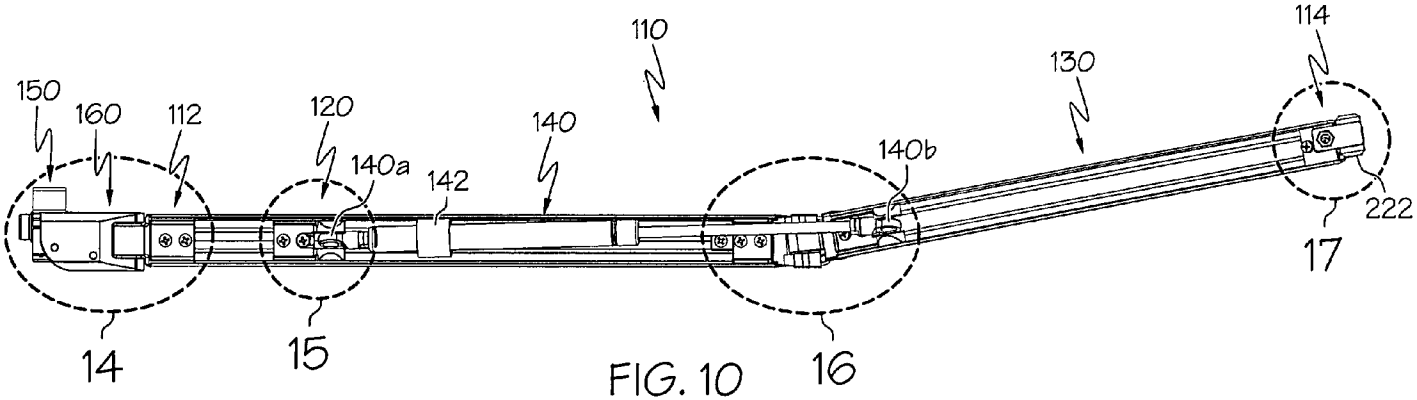
FIG. 10 is a side view of the example arm assembly of FIG. 8.
Figure 12:
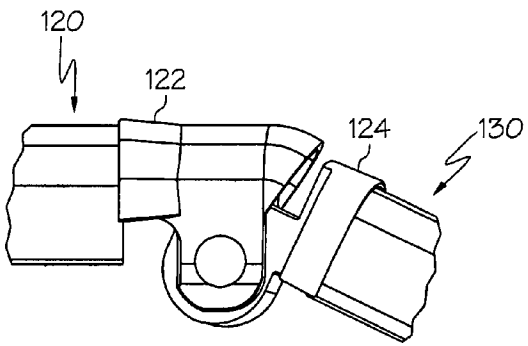
FIG. 12 is an enlarged view of portions of the arm assembly taken at view 12 of FIG. 8.
Figure 11:
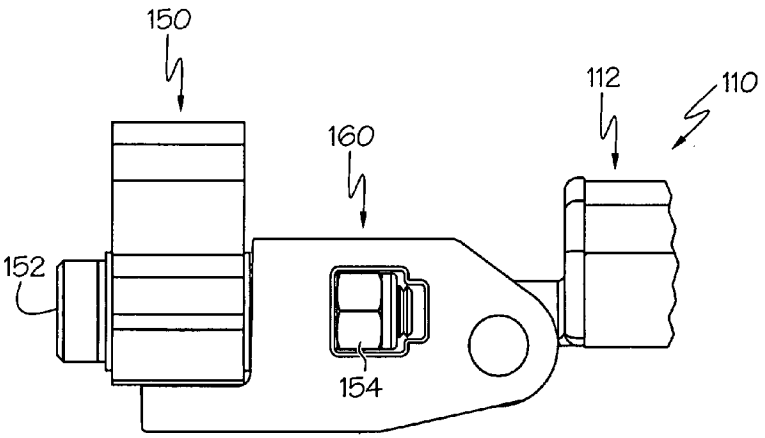
FIG. 11 is an enlarged view of portions of the arm assembly taken at view 11 of FIG. 8.
Figure 13:
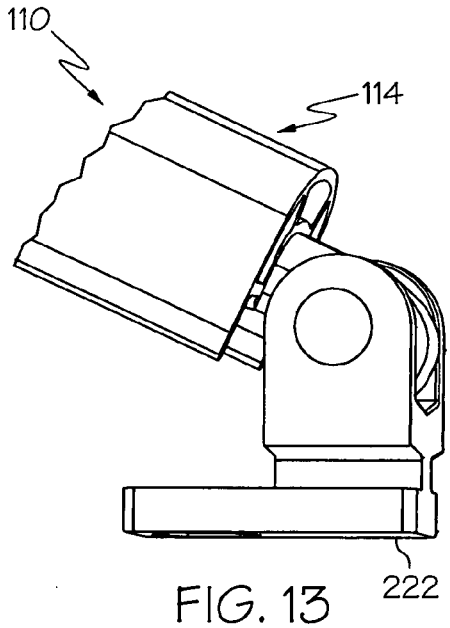
FIG. 13 is an enlarged view of portions of the arm assembly taken at view 13 of FIG. 8.
Figure 14:
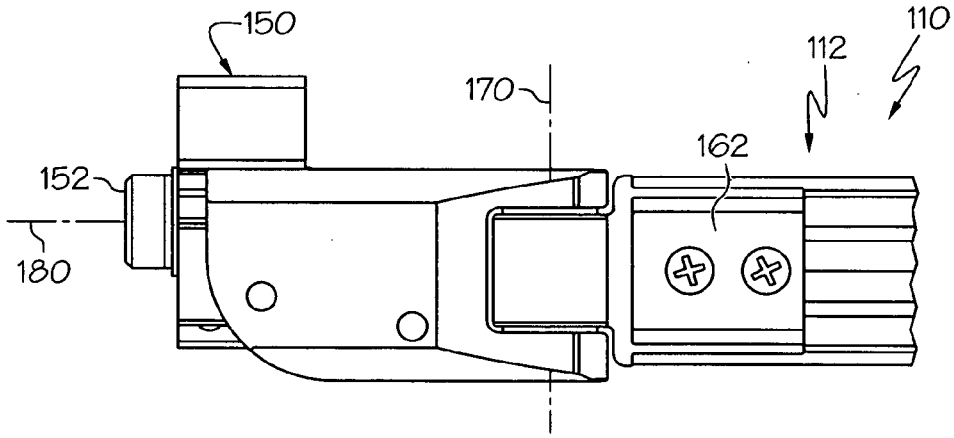
FIG. 14 is an enlarged view of portions of the arm assembly taken at view 14 of FIG. 10.
Figure 16:
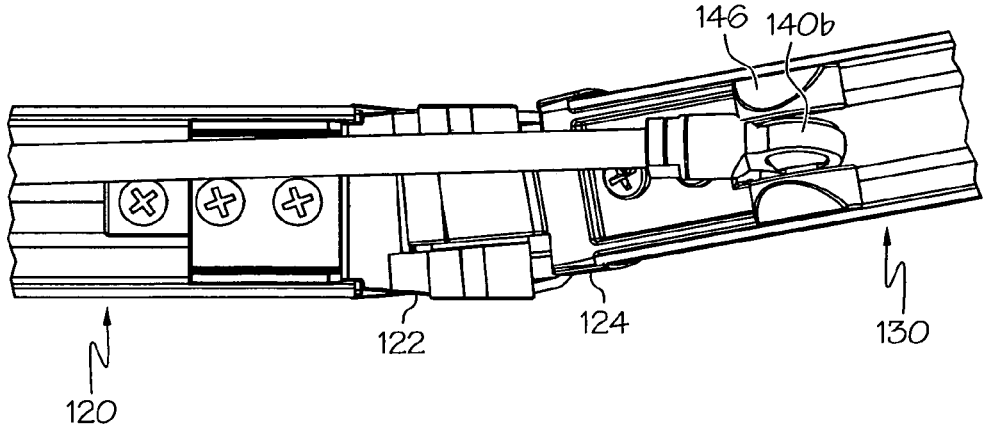
FIG. 16 is an enlarged view of portions of the arm assembly taken at view 16 of FIG. 10.
Figure 17:
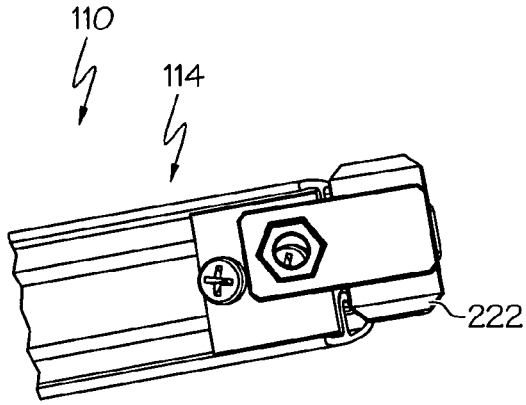
FIG. 17 is an enlarged view of portions of the arm assembly taken at view 17 of FIG. 10.

The second segment 130 can be pivotally connected to the first segment 120 in a wide variety of ways. For example, as shown in FIGS. 8, 10, 12 and 16, a pivot structure can be provided with a first pivot member 122 attached to the first segment 120 and a second pivot member 124 attached to the second segment 130. In some examples, there is no elevational angle between the first and second segment 120, 130. Alternatively, as shown in FIGS. 10 and 16, the first and second pivot member 122, 124 may be designed to provide an elevational angle between the first and second segments 120, 130. If provided, the elevational angle can comprise a wide range of angles depending on the particular application. For instance, an elevational angle between the first and second segments 120, 130 of from greater than 0° to approximately 45° can be provided. In further examples, an elevational angle between the first and second segments 120, 130 of from greater than 3° to approximately 20° can be provided. In still further examples, an elevational angle between the first and second segments 120, 130 of about 5° or about 12° can be provided. While optional, providing an elevational angle between the first and second segments may be desirable to help position a sheet of flexible awing material 102 above portions of the first and second segments as shown in FIG. 1.

Figure 8:
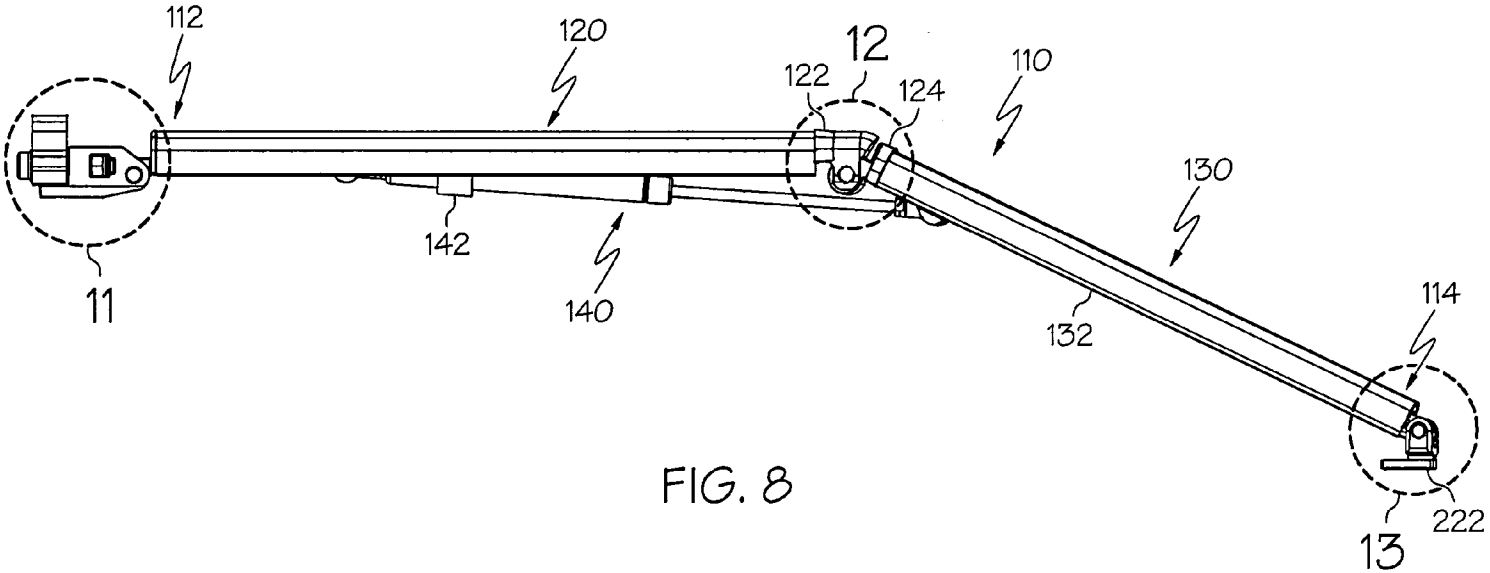
FIG. 8 is a top view of an example arm assembly in an open orientation incorporating aspects of the present invention.
Figure 9:
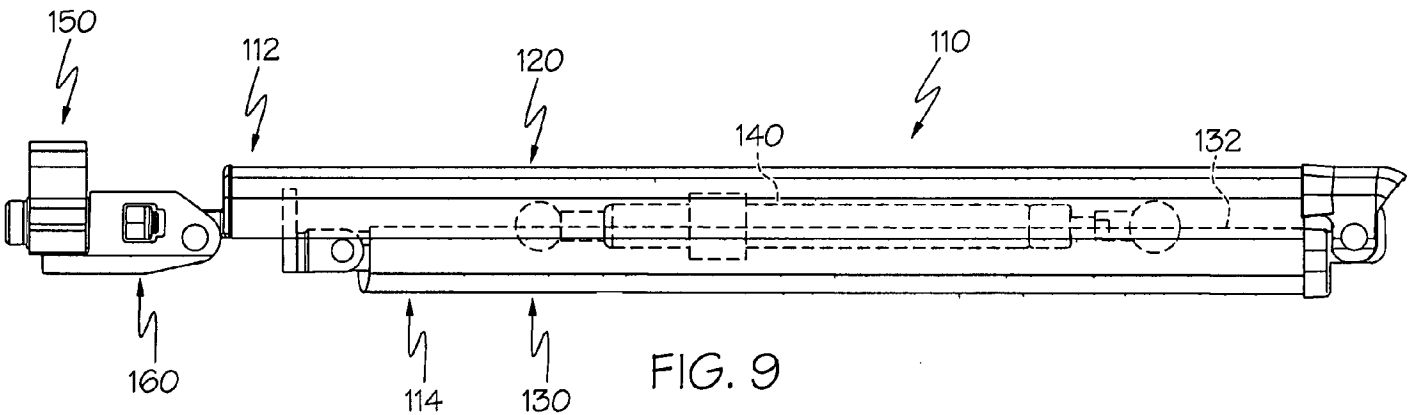
FIG. 9 is a top view of the arm assembly of FIG. 8 in a closed orientation.

The at least one arm assembly 110 can further include a first biasing member 140 extending between portions of the first and second segments 120, 130. In some examples, the first and second segments 120, 130 are configured to pivot relative to one another between an open orientation (see FIGS. 8 and 10) with the first biasing member 140 being exposed and a closed orientation (see FIG. 9) with the first biasing member being substantially hidden within an area defined by the first and second segments 120, 130. The area that hides the first biasing member 140 in the closed orientation can be defined entirely by one of the first or second segment with the other of the first and second segment acting as a cover for the area. Alternatively, as shown, the area that hides the first biasing member 140 in the closed orientation can be defined by portions of the first and second segment. Moreover, the first segment, second segment, and/or the first biasing member 140 may be configured to facilitate the closed orientation illustrated in FIG. 9. For example, as shown in FIGS. 8 and 9, the second segment 130 may include a male lip portion 132 configured to fit within an interior area or a female groove of the first segment 120 to allow an enhanced fit between the segments in the closed orientation. In further examples, the first biasing member 140 may include an alignment structure 142 configured to align the first biasing member 140 within the first segment 120 as the first and second segments are moved between the open orientation and the closed orientation. The alignment structure 142, for example, can comprise a ring of material configured to extend around the first biasing member 140 to provide a thickness of material on the sides of the first biasing member that face interior surfaces of the first segment 120. As the first and second segments are moved to the closed orientation, the ring of material will tend to align the first biasing member 140 within the interior area of the first segment 120.

The first biasing member 140 can comprise a wide range devices configured to bias the first and second segments 120, 130 to the open or closed orientation. In the illustrated example, the first biasing member 140 is configured to bias the first and second segments 120, 130 to the open orientation although it is contemplated that further examples may include a biasing member that biases the first and second segments to the closed orientation. Furthermore, the first biasing member 140 may be constructed from a wide range of devices. For example, the first biasing member 140 can comprise a coil spring or other biasing mechanism. In the illustrated example, the first biasing member 140 comprises a gas spring with a first end 140*a* attached to a portion of the first segment 120 and a second end 140*b* attached to a portion of the second segment 130.

Figure 15:
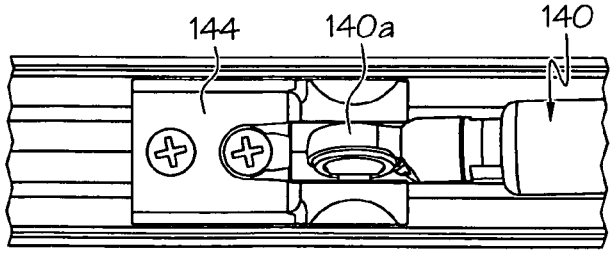
FIG. 15 is an enlarged view of portions of the arm assembly taken at view 15 of FIG. 10.

A wide range of structures may be used to attach the ends of the first biasing member 140 to the respective segments. For example, as shown in FIG. 15, the first end 140*a* of the first biasing member 140 may be attached to the first segment 120 by a first attachment bracket 144. Likewise, as shown in FIG. 16, the second end 140*b* of the first biasing member 140 may be attached to the second segment 130 by a second attachment bracket 146. The attachment brackets 144, 146 can be adjustably attached to the respective first and second segments 120, 130. For example, the brackets may be attached at alternative locations along the length of the respective segments to allow an appropriate precompression of the first biasing member 140 depending on the particular application.

Figure 5:
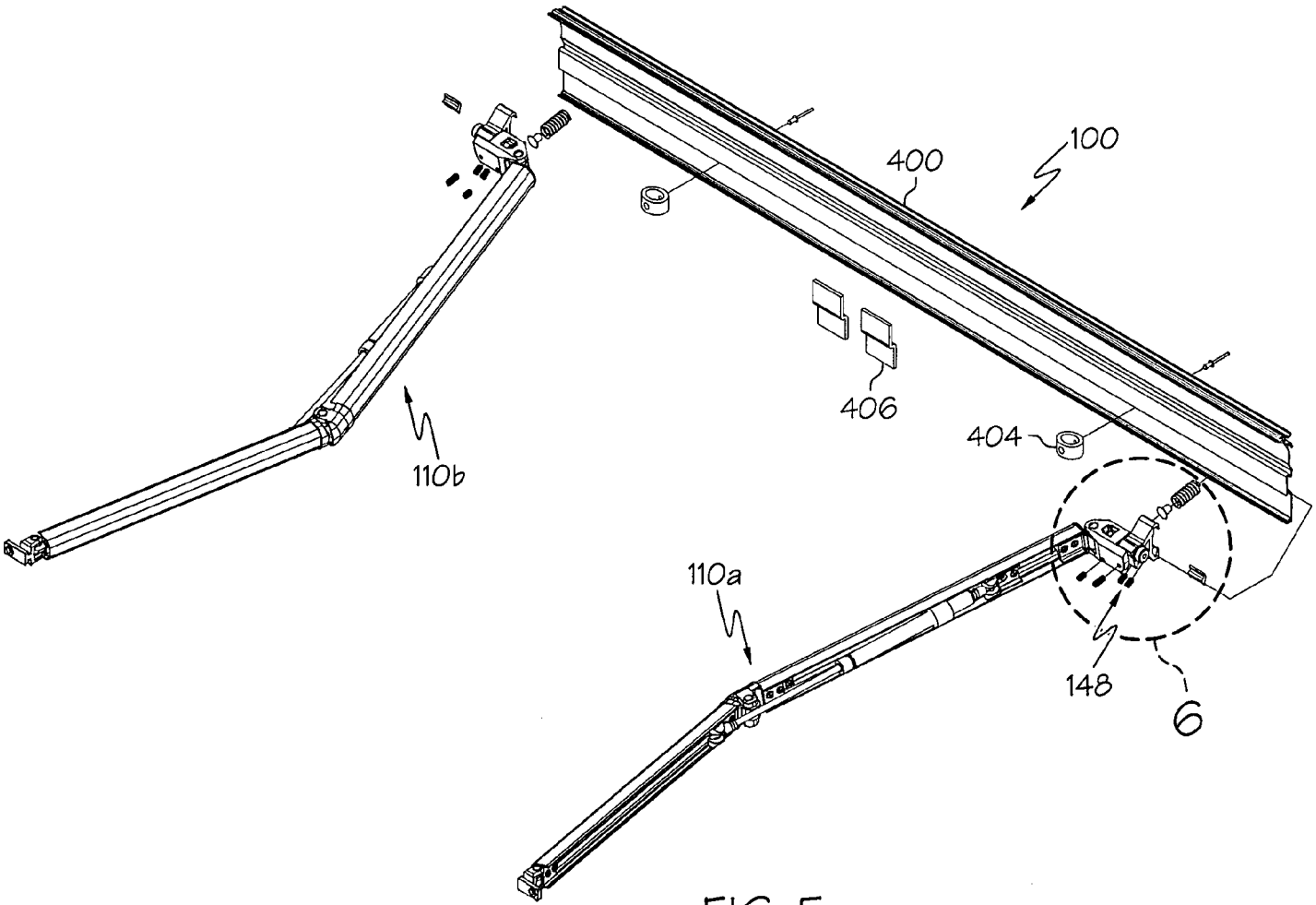
FIG. 5 is still another perspective view of a partial exploded awning assembly incorporating aspects of the present invention.
Figure 6:
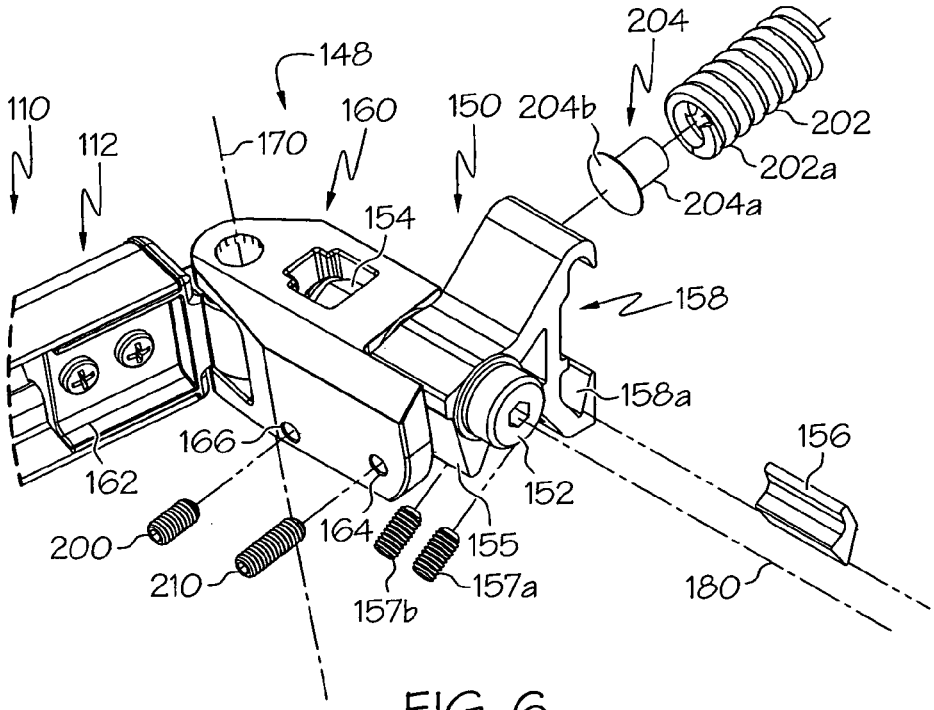
FIG. 6 is an enlarged view of portions of the awning assembly taken at view 6 of FIG. 5.
Figure 7:
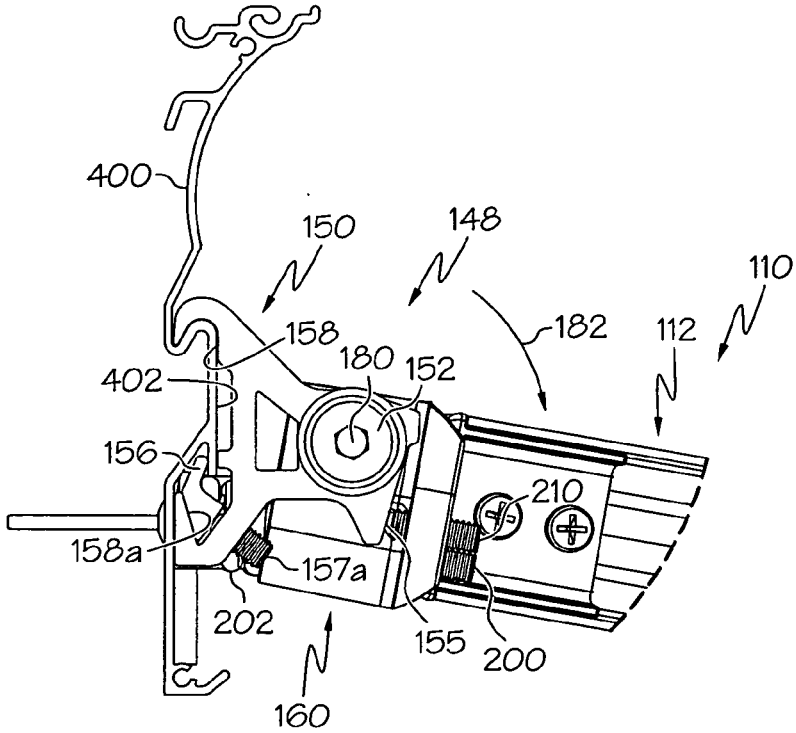
FIG. 7 is a side assembled view of portions of the awning assembly.

In examples of the present invention, the arm assembly 110 can be attached between the support structure 600 and a lead rail 220. As shown in FIGS. 4-7, an arm mount assembly 148 may be used to mount the arm assembly 110 to a back cover 400 which may be, in turn, attached to the support structure 600. As shown in FIGS. 6 and 7, the arm mount assembly 148 may comprise a first mounting bracket 150 configured to mount to a support structure. As shown, the first mounting bracket 150 is configured to mount indirectly to the support structure 600 by way of the back cover 400. Although not shown, it is contemplated that the mounting bracket may also be configured to mount directly to the support structure.

The arm mount assembly 148 can also include a link member 160 pivotally attached between the arm assembly 110 and the first mounting bracket 150. As shown, the arm assembly 110 is configured to pivot with respect to the link member 160 about a first pivot axis 170 and the link member is configured to pivot with respect to the mounting bracket about a second pivot axis 180. Although not required, as shown, the first and second axis 170, 180 may be substantially perpendicular with respect to one another. As shown in FIG. 6, a pivot device 162 may be attached to a first end portion 112 of the arm assembly 110 such that the arm assembly may pivot with respect to the link member about the first pivot axis 170. As further illustrated in FIG. 6, the link member 160 may be pivotally attached to the first mounting bracket 150 by way of a pivot bolt 152 extending through a bore of the first mounting bracket 150 and link member 160 at attached by way of a nut 154 at the end of the pivot bolt 152.

As further illustrated in FIGS. 6 and 7, the first mounting bracket 150 may be provided with a mounting shim 156 configured to fit within a lower portion 158*a* of a groove 158 of the first mounting bracket 150. A pair of set mounting screws 157*a*, 157*b* are configured to press against the mounting shim 156 to attach the first mounting bracket 150 to the back cover 400. As is apparent in FIG. 7, to mount the first mounting bracket 150 to the back cover 400, the groove 158 of the first mounting bracket 150 may be inserted over a tongue portion 402 of the back cover 400. Next, the mounting shim 156 may be inserted in the lower portion 158*a* of the groove 158 to provide an interlock between the first mounting bracket 150 and the back cover 400. Next the mounting screws 157*a*, 157*b* can be tightened to attach the first mounting bracket 150 to the back cover 400.

The arm mount assembly 148 can also include a structure configured to limit a rotation of the link member 160 with respect to the first mounting bracket 150 about the second pivot axis 180. For example, as shown in FIGS. 6 and 7, a stop device 210, such as the illustrated stop screw, may be threaded through a first bore 164 in the link member 160 to act against a shoulder 155 of the first mounting bracket 150. As shown in FIG. 7, the stop device 210 can limit a clockwise pivot 182 of the arm assembly 110 about the second pivot axis 180 due to the weight of the arm assembly and structures supported by the arm assembly.

Still further, the arm mount assembly 148 can include a second biasing member 202 further configured to resist rotation of the link member 160 with respect to the first mounting bracket 150 about the second pivot axis 180. An insert portion 204*a* of a bearing pin 204 may be inserted into an end portion 202*a* of the second biasing member 202. The end portion 202*a*, together with the bearing pin 204, may then be inserted in a bore (not shown) in the back of the link member 160. As shown in FIG. 7, the second biasing member 202 presses against the back cover 400 below the second pivot axis 180. Referencing FIG. 7, it will therefore be appreciated that the second biasing member 202 is configured to provide a reactive moment force in a counterclockwise direction about the second pivot axis 180 to counter the tendency of the pivot link to rotate about the second pivot axis 180 in the clockwise direction 182 due to the weight of the arm assembly 110 and structures supported by the arm assembly. The second biasing member 202 can comprise a wide range of structures. As shown, the second biasing member 202 can comprise a compression spring although it is contemplated that a resilient piece of rubber, leaf spring, or other biasing mechanism may be used in further examples. In still further examples, an adjustment device 200, such as the illustrated adjustment screw, may be provided and configured to adjust the compression of the second biasing member 202. As shown, the adjustment device 200 may be threaded through a second bore 166 and thereafter tightened to press against the bearing head 204*b* to increase the reactive moment force or loosened to decrease the reactive moment force. Providing an adjustment device 200 may therefore allow a user to fine tune the awning assembly 100 to accommodate different environments, or to adjust the device to accommodate different loads.

As mentioned previously, the arm assembly 110 may be attached between the support structure 600 and the lead rail 220. As discussed above, the arm mount assembly 148 may be used to mount the first end portion 112 of the arm assembly 110 to the support structure 600 by way of the back cover 400. In one example, as shown in FIGS. 4, 8, 10, 13 and 17, a lead rail pivot bracket 222 may be used to pivotally attach a second end portion 114 of the arm assembly 110 to the lead rail 220.

Figure 3:
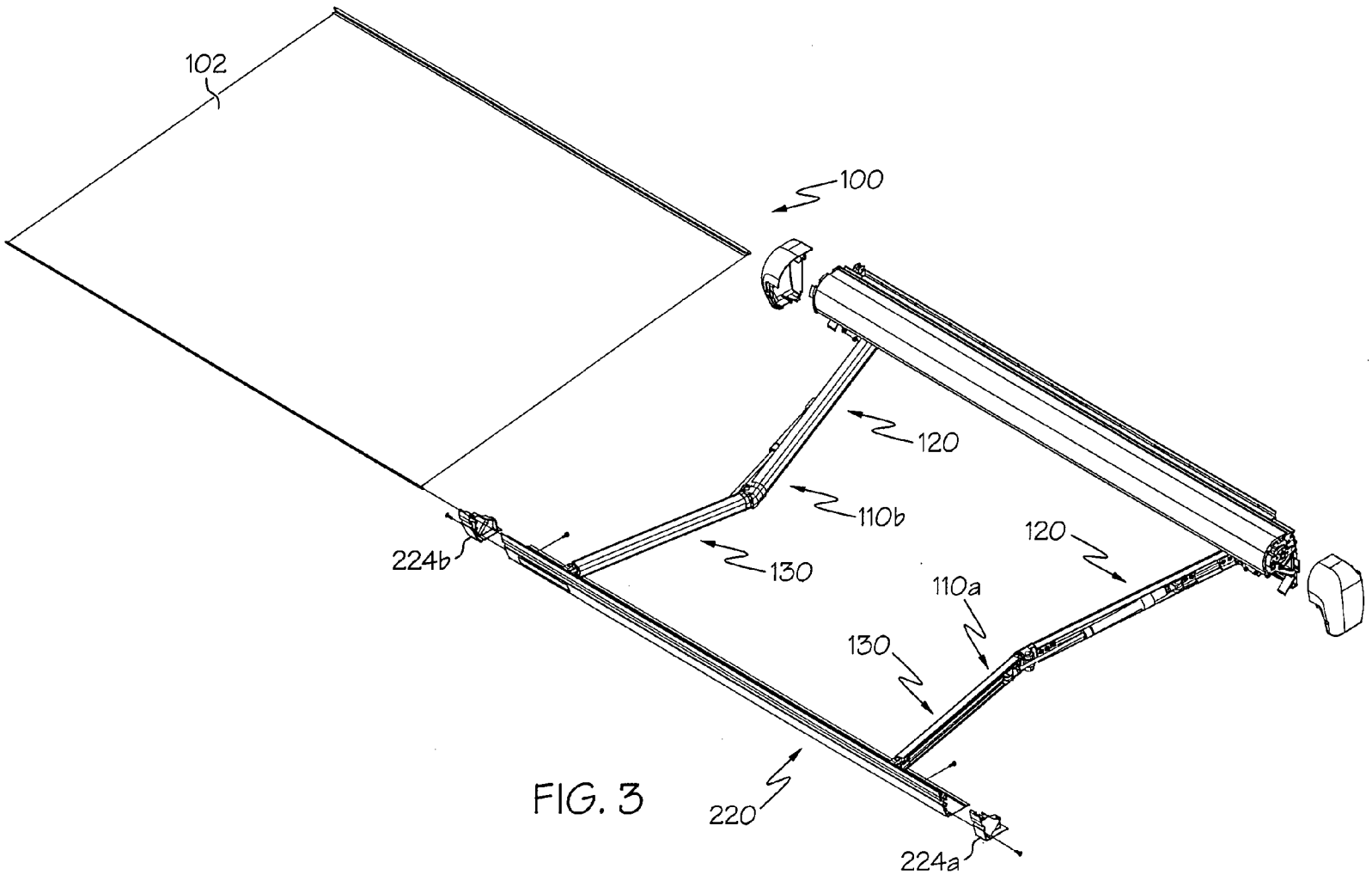
FIG. 3 is a perspective view of a partial exploded awning assembly incorporating aspects of the present invention.
Figure 4:
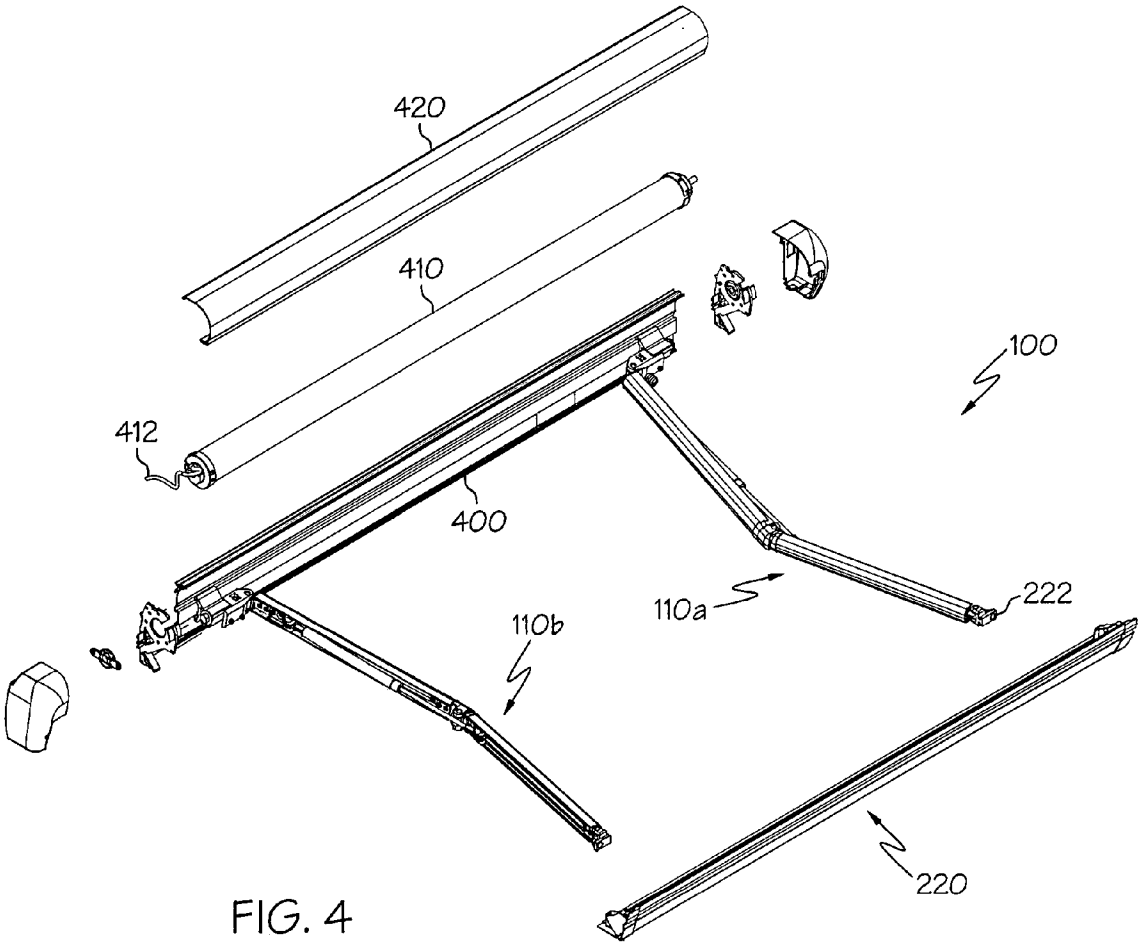
FIG. 4 is another perspective view of a partial exploded awning assembly incorporating aspects of the present invention.

As shown in FIG. 4, the awning assembly 100 can further include a roller tube 410 for mounting with respect to the back cover 400. A top cover 420 can be placed over the back cover 400 in order to house the roller tube 410 and sheet of flexible awning material 102 that may be selectively rolled onto the roller tube 410. A motor may be housed within the roller tube with electrical contacts 412 extending from the roller tube 410 to connect with a control mechanism to control the deployment and retraction of the awning assembly 100. As shown in FIG. 3, the sheet of flexible awning material 102 is shown exploded from the remaining portions of the awning assembly. One end of the awning material 102 may be attached to the roller tube 410 while the other end of the awning material 102 may be engaged with a portion of the lead rail 220. Once attached to the lead rail 220, a pair of lead rail end brackets 224*a*, 224*b* may be used to secure the corresponding end of the awning material 102 with respect to the lead rail 220. As shown in FIG. 5, the back cover 400 may also be provided with one or more optional bumpers 404 configured to interact with each arm assembly 110 when the arm assembly is in a closed orientation. In the closed orientation, a surface of the first segment 120 will contact the bumper member 404 to help position the first segment 120 with respect to the back cover 400. Optional foam material members 406 may also be provided to help prevent scratching of the arm assembly 110 in the closed orientation.

In certain applications, the at least one arm assembly 110 of the awning assembly 100 may have a single arm assembly. As shown, it is also possible for the at least one arm assembly 110 to comprise two arm assemblies 110*a*, 110*b* although three or more arm assemblies may be incorporated in further examples. Providing two arm assemblies may be desirable to provide support at each end of a lead rail 220. Although the arm assemblies may be different from one another, the illustrated arm assemblies may be designed as substantial mirror images of one another.

If a plurality of arm assemblies are provided, they may be arranged in a wide variety of orientations. For example, as apparent in FIG. 3, the pivot connection between the first segment 120 and the second segment 130 of each arm assembly 110*a*, 110*b* will be closer together in the closed orientation than in the open orientation. Arranging the first and second arm assemblies 110*a*, 110*b* in this manner may be beneficial to allow appropriate spacing of the arm assemblies to provide support at each end of the lead rail 220 in the open orientation while also allowing the arm assemblies to fold in a compact manner when the arm assemblies are positioned in the closed orientation.

The awning assembly 100 may also be provided with one or more support legs attached to the lead rail 220 to provide supplemental support for the lead rail 220 when the arm assembly 110 is positioned in the open orientation. In one example, the support legs can be configured to engage a ground surface underneath the lead rail. In further examples, the support legs may be pivoted back to engage with the support structure 600. The support legs may be attached to the lead rail in a pivoting manner and may be designed to fold up into the lead rail in a stowed position. A pivot assembly 500 may be used to facilitate movement of the support leg from a deployed position to a stowed position.

The pivot assembly 500 can comprise a wide range of configurations to permit the first support leg 230 to be pivotally connected to the lead rail 220 such that the first support leg 230 can pivot to the stowed position with respect to the lead rail 220. FIGS. 20-24 illustrate aspects of one example of a pivot assembly 500 incorporating aspects of the present invention. As shown, the pivot assembly 500 can include a pivot bracket 510 that can include apertures 512 to attach the pivot bracket 510 to the lead rail 220. Rather than apertures, the pivot bracket 510 may be simply tack welded, glued, or otherwise connected to the lead rail 220. The pivot assembly 500 can also include a pivot arm 520 pivotally attached to the first support leg 230 to permit the first support leg 230 to pivot about a first axis 522 in a first direction. The pivot assembly 500 can further include a pivot link 530 pivotally attaching the pivot arm 520 to the pivot bracket 510. The pivot arm 520 can be configured to pivot with respect to the pivot link 530 about the second axis 532 extending in a second direction that is substantially perpendicular to the first direction. The pivot link 530 can still be further configured to pivot with respect to the pivot bracket 510 about a third axis 534 extending in a third direction that is substantially perpendicular to the first axis 522 and the second axis 532. In further examples, the pivot assembly 500 can include a first stop member 536 configured to limit the extent to which the pivot link 530 can pivot with respect to the pivot bracket 510. In addition or alternatively, the pivot assembly 500 can further include a second stop member 524 configured to limit the extent to which the pivot arm 520 can pivot with respect to the pivot link 530.

Figure 24:
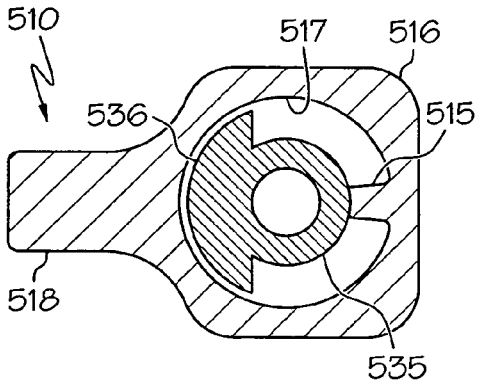
FIG. 24 is a sectional view of the pivot assembly along line 24-24 of FIG. 20.
Figure 25:
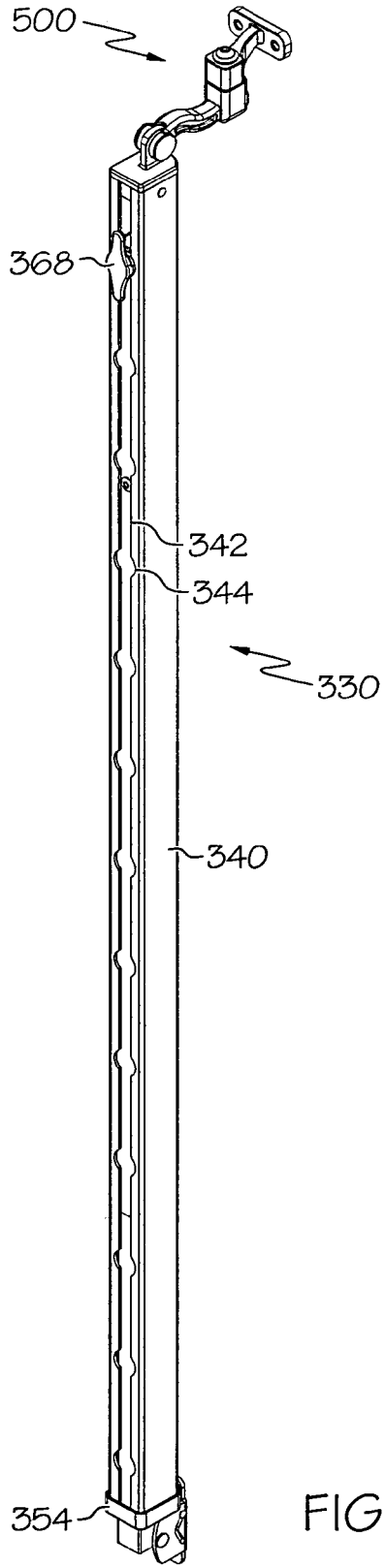
FIG. 25 is a perspective view of an example second support leg incorporating aspects of the present invention.

The pivot assembly 500 can be arranged in a wide variety of ways to achieve the structural relationships described above. For example, the pivot bracket 510 can include a mounting portion 514, an interface portion 516 and a neck 518 joining the mounting portion 514 and the interface portion 516. As shown in FIG. 24, the interface portion 516 can include a first pivot bore 517 with an extension 515 configured to interfere with the first stop member 536 to resist rotation about the third pivot axis 534.

Figure 20:
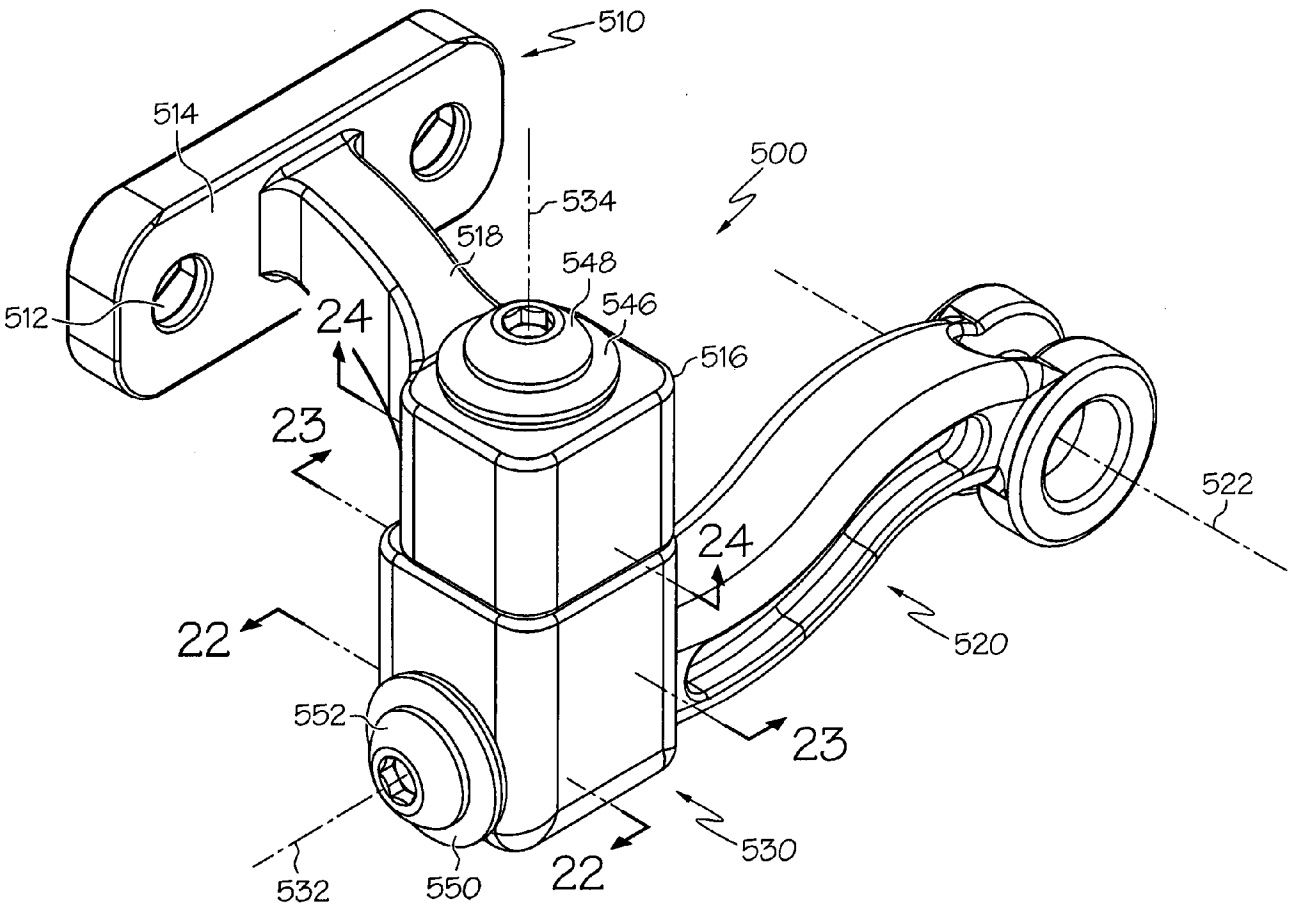
FIG. 20 is a perspective view of an example pivot assembly for a support leg incorporating aspects of the present invention.
Figure 21:
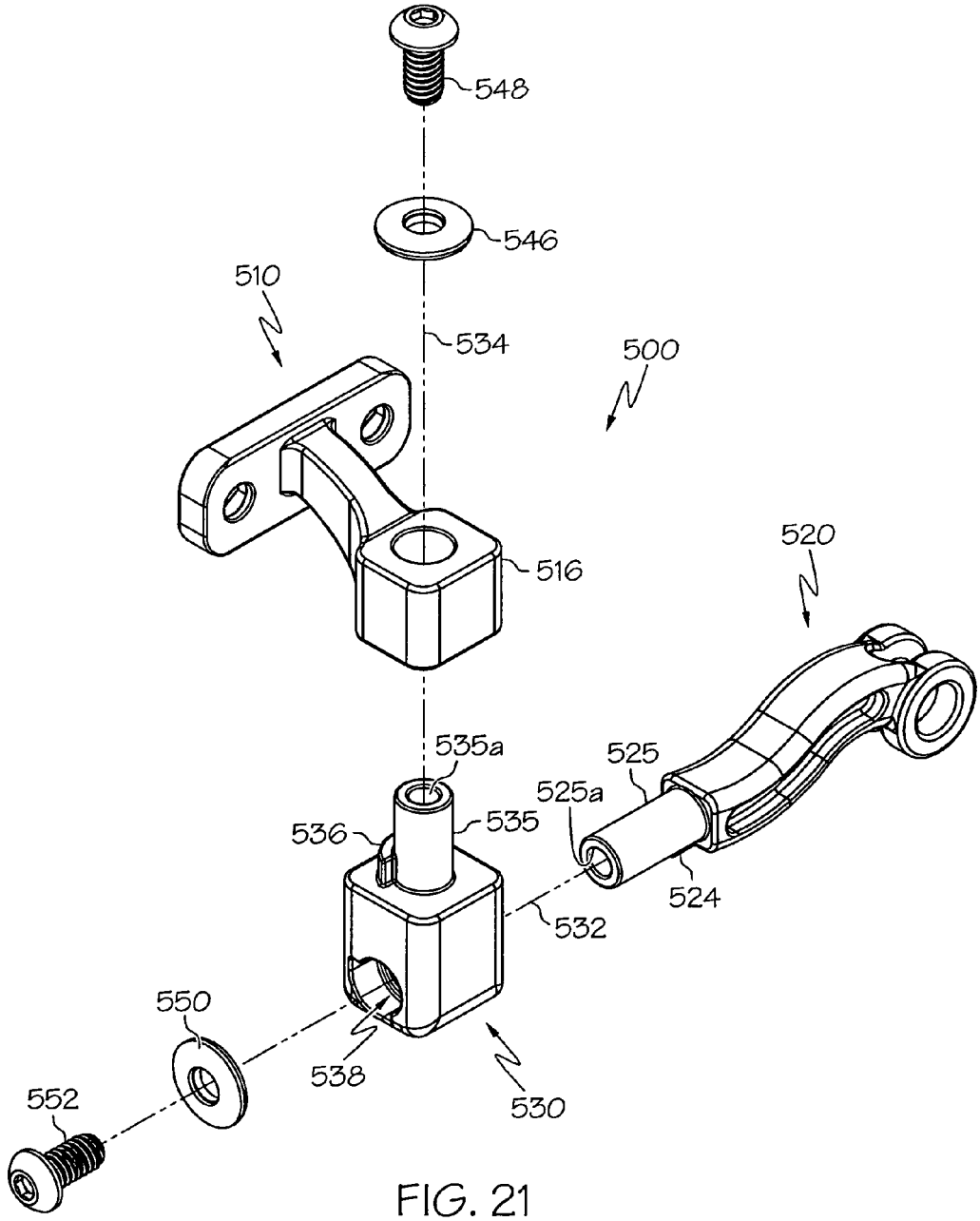
FIG. 21 is an exploded view of the pivot assembly of FIG. 20.

The pivot link 530 can also include a first pivot pin 535 extending from the top surface of the pivot link 530 along the third pivot axis 534. The first pivot pin 535, together with the first stop member 536 can be inserted within the first pivot bore 517 of the pivot bracket 510 and fastened in place. Indeed, as shown in FIGS. 20 and 21, a first washer 546 may be placed over a top surface of the interface portion 516. Next, a first fastener 548 may be inserted through the first washer 546, through an aperture in the top surface of the interface portion 516 and threaded into an interior threaded bore 535*a* of the first pivot pin 535. Once attached together, as shown in FIG. 24, the first stop member 536 of the pivot link 530 is configured to interact with the extension 515 of the pivot bracket 510 to limit the extent to which the pivot link 530 can pivot with respect to the pivot bracket 510.

Figure 23:
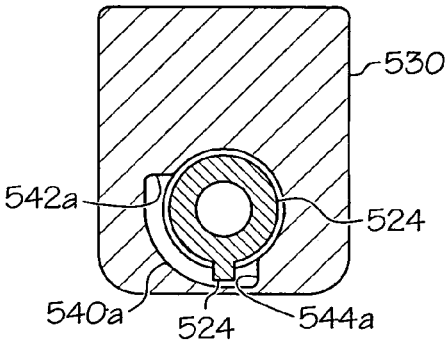
FIG. 23 is a sectional view of the pivot assembly along line 23-23 of FIG. 20.
Figure 22:
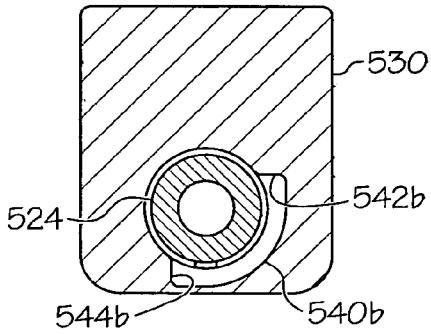
FIG. 22 is a sectional view of the pivot assembly along line 22-22 of FIG. 20.

The pivot assembly 500 can also include a second stop member 524 configured to limit the extent to which the pivot arm 520 can pivot with respect to the pivot link 530. Although the first and second stop members 536, 524 are illustrated together, further examples of the pivot assembly 500 may only include the first stop member 536 or may only include the second stop member 524. As further shown in FIG. 21, the pivot arm 520 can include a second pivot pin 525 extending from the side of the pivot arm 520 along the second pivot axis 532. The second pivot pin 525, together with the second stop member 524 can be inserted within the second pivot bore 538 defined in the pivot link 530 and fastened in place. Indeed, as shown in FIGS. 20 and 21, a second washer 550 may be placed over a side surface of the pivot link 530. Next, a second fastener 552 may be inserted through the second washer 550, through an aperture in the side surface of the pivot link 530 and threaded into an interior threaded bore 525*a* of the second pivot pin 525. Once attached together, as shown in FIG. 23, the second stop member 524 of the pivot arm 520 is configured to travel within the arcuate slot 540*a* and interact with first and second shoulders 542*a*, 544*a* to limit the extent to which the pivot arm 520 can pivot with respect to the pivot link 530 about the second pivot axis 532.

Although not shown, in an alternate configuration, the second pivot pin 525 of the pivot arm 520 may be inserted through an aperture in the opposite side surface of the pivot line 530 to provide a pivot assembly 500 that may be mounted to an opposite end of the lead rail 220. Once attached together, with reference to FIG. 22, the second stop member 524 of the pivot arm 520 would be configured to travel within a second arcuate slot 540*b* and interact with first and second shoulders 542*b*, 544*b* of the second arcuate slot 540*b* to limit the extent to which the pivot arm 520 can pivot with respect to the pivot link 530 about the second pivot axis 532. Thus, the second arcuate slot 540*b* allows alternate mounting of the pivot arm 520 between opposite sides of the pivot link 530 to allow the pivot assembly 500 to be assembled as a right or left side pivot assembly.

Figure 18:
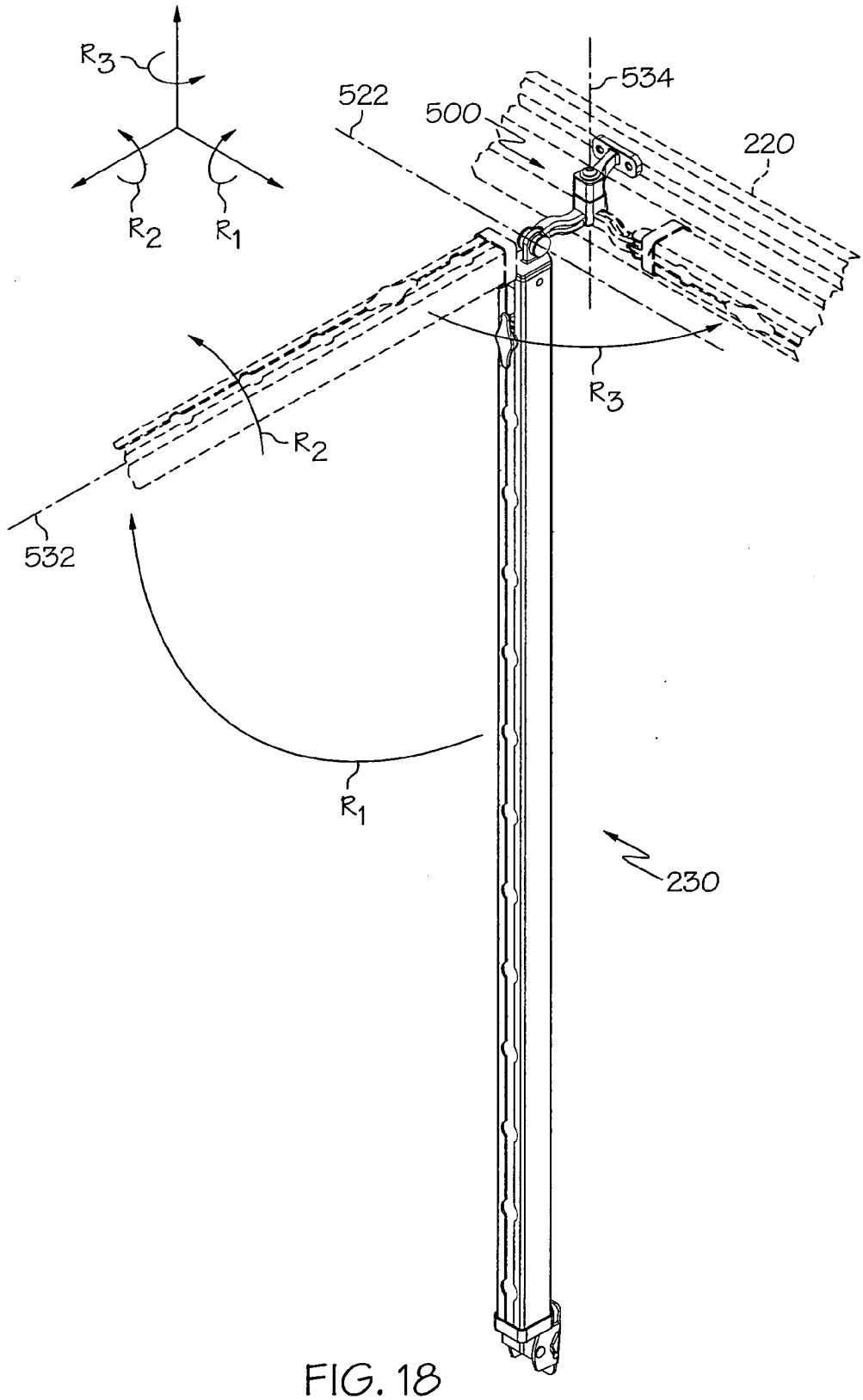
FIG. 18 is a perspective illustration of an example first support leg being pivoted from a deployed position to a stowed position with respect to a lead rail of an awning assembly.

Use of the pivot assembly 500 to assist in pivoting the first support leg 230 from the deployed position to the stowed position will now be described with reference to FIG. 18. In order to stow the first support leg 230, a user may first pivot the first support leg 230 about a first axis 522 along pivot arrow $R_1$ by approximately 90° along pivot arrow R. A stop may be incorporated to limit the extent to which the first support leg 230 pivots along pivot arrow $R_1$.

Next, the user may rotate the first support leg 230 about a second axis 532 along pivot arrow $R_2$. A user will be prevented from rotating the first support leg 230 in a direction opposite to pivot arrow $R_2$ by an interaction between the second stop member 524 and the second shoulder 544*a*. As the user rotates the first support leg 230 about the second axis 532 in the $R_2$ direction, the second stop member 524 travels within the arcuate slot 540*a* until the second stop member 524 engages the first shoulder 542*a* to limit the extent to which the pivot arm 520 may pivot with respect to the pivot link 530. In one example, the second stop member 524 provides at least about a 90° limit to which the pivot arm 520 can pivot with respect to the pivot link 530. In a further example, the second stop member 524 provides about a 90° limit to which the pivot arm 520 can pivot with respect to the pivot link 530.

Finally, the user may rotate the first support leg 230 about a third axis 534 along pivot arrow R3. A user will be prevented from rotating the first support leg 230 in a direction opposite to pivot arrow R3 by an interaction between the first stop member 536 and the extension 515. As the user rotates the first support leg 230 about the third axis 534 in the R3 direction, the first stop member 536 travels within the first pivot bore 517 until the first support leg 230 engages the back of the lead rail 220. Thus, the first stop member 536 together with the lead rail 220 provides a limit to which the pivot link 530 can pivot with respect to the pivot bracket 510. In one example, the first stop member 536 together with the lead rail 220 provides at least about a 90° limit to which the pivot link 530 can pivot with respect to the pivot bracket 510. In a further example, the first stop member 536 together with the lead rail 220 provides about a 90° limit to which the pivot link 530 can pivot with respect to the pivot bracket 510. After pivoting about the third pivot axis 534, the first support leg 230 is stowed within an interior area of the lead rail 220.

Figure 19:
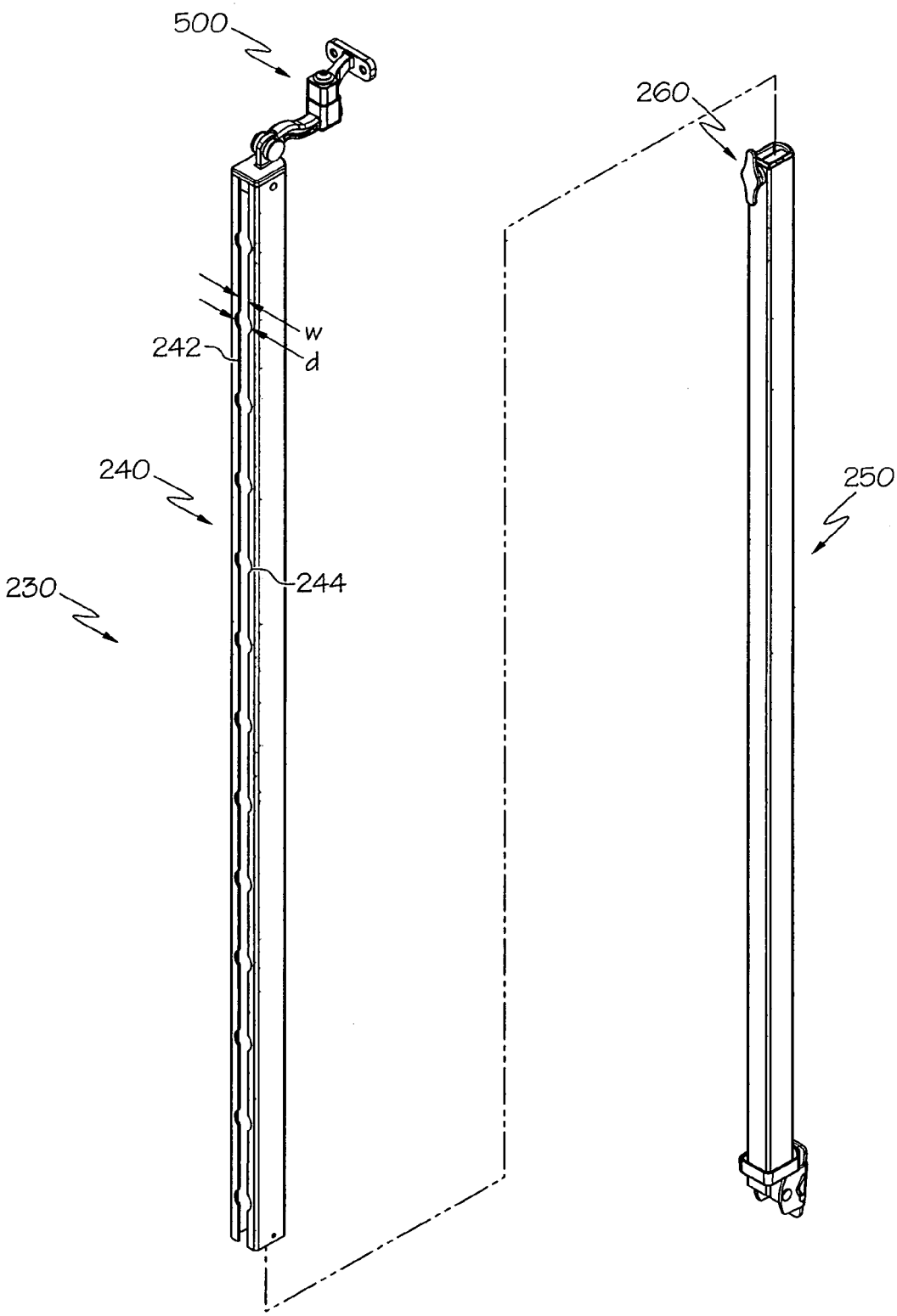
FIG. 19 is a partial exploded view of the first support leg of FIG. 18.
Figure 26:
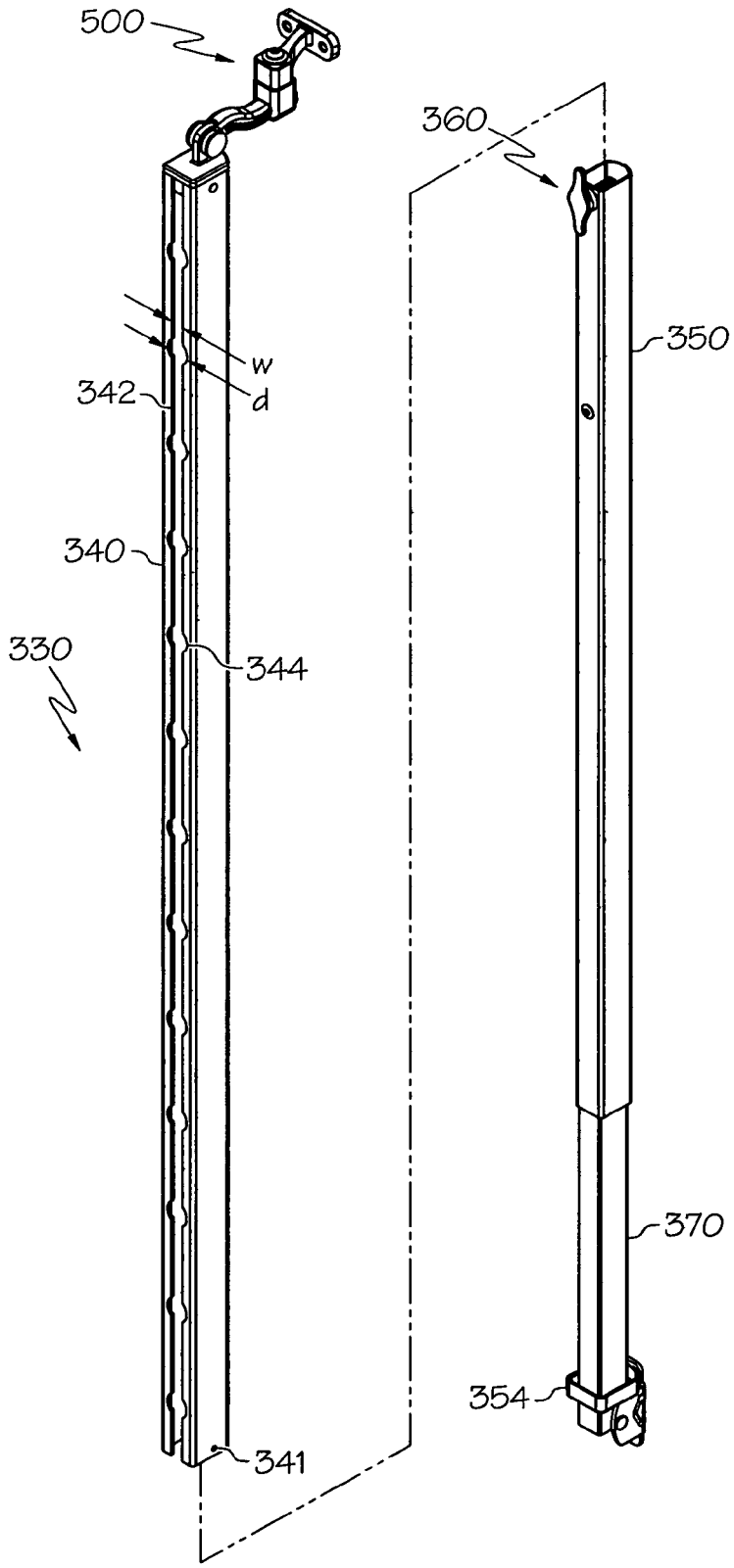
FIG. 26 is a partial exploded view of the second support leg of FIG. 25.
Figure 27:
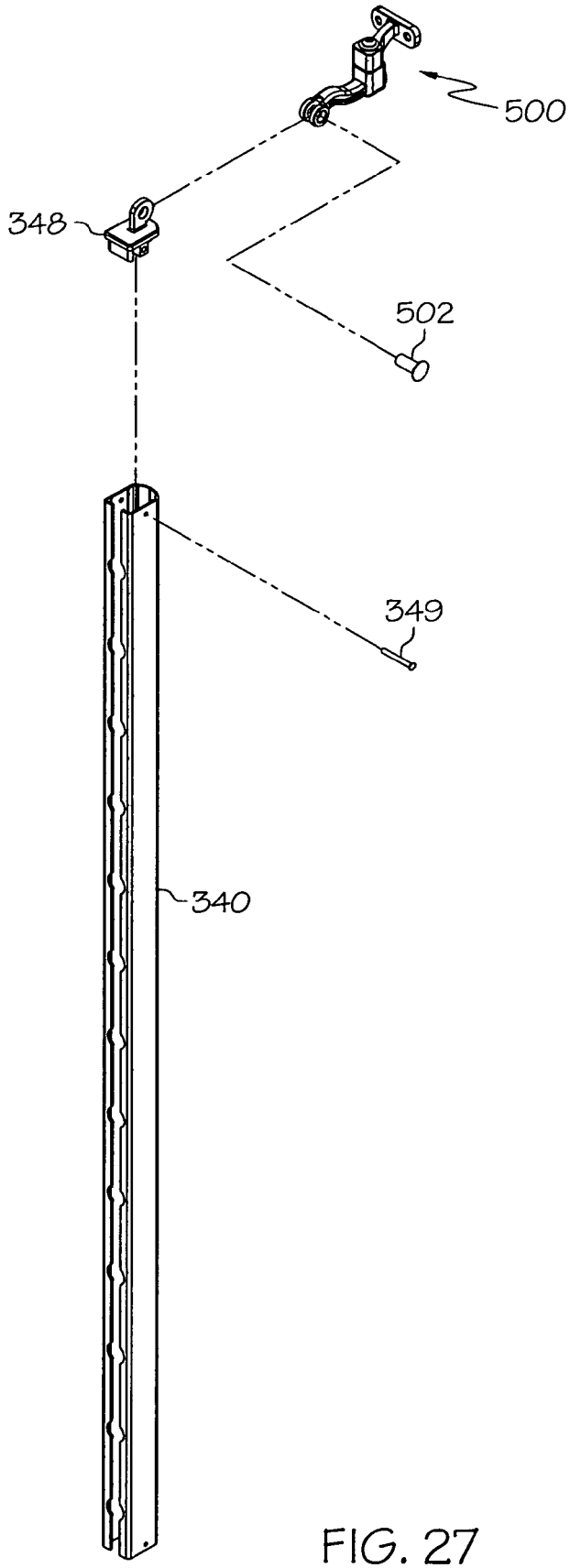
FIG. 27 is an exploded view of a first segment of the second support leg of FIG. 26.

In accordance with further examples of the present invention, the awning assembly 100 may include a second support leg 330 in addition to the previously mentioned first support leg 230. As shown in FIGS. 19 and 26, each support leg 230, 330 can include a first segment 240, 340 configured to be attached to the lead rail 220, for instance, with the above mentioned pivot assembly 500. The process of mounting the pivot assembly 500 to the first segment is illustrated with respect to the first segment 340 illustrated in FIG. 27 wherein it is apparent that a similar or identical mounting process may apply for the first segment 240. As shown in FIG. 27, an end cap 348 may be mounted the first segment 340, for example, by way of a first rivet 349 or other fastening structure. A pivot pin 502 may then be used to pivotally attach the pivot assembly 500 to the end cap 348.

Each support leg 230, 330 can further include a second segment 250, 350 attached to the first segment 240, 340, and a locking device 260, 360 configured to selectively lock the second segment 250, 350 with respect to the first segment 240, 340 in a selected one of a plurality of alternate relative positions to allow the support legs 230, 330 to be selectively locked in one of a plurality of predetermined incremental lengths. Allowing each of the support legs 230, 330 to be incrementally locked can be beneficial to allow each support leg 230, 330 to obtain an identical length which may prove difficult to achieve with infinitely adjustable support legs.

Figure 28:
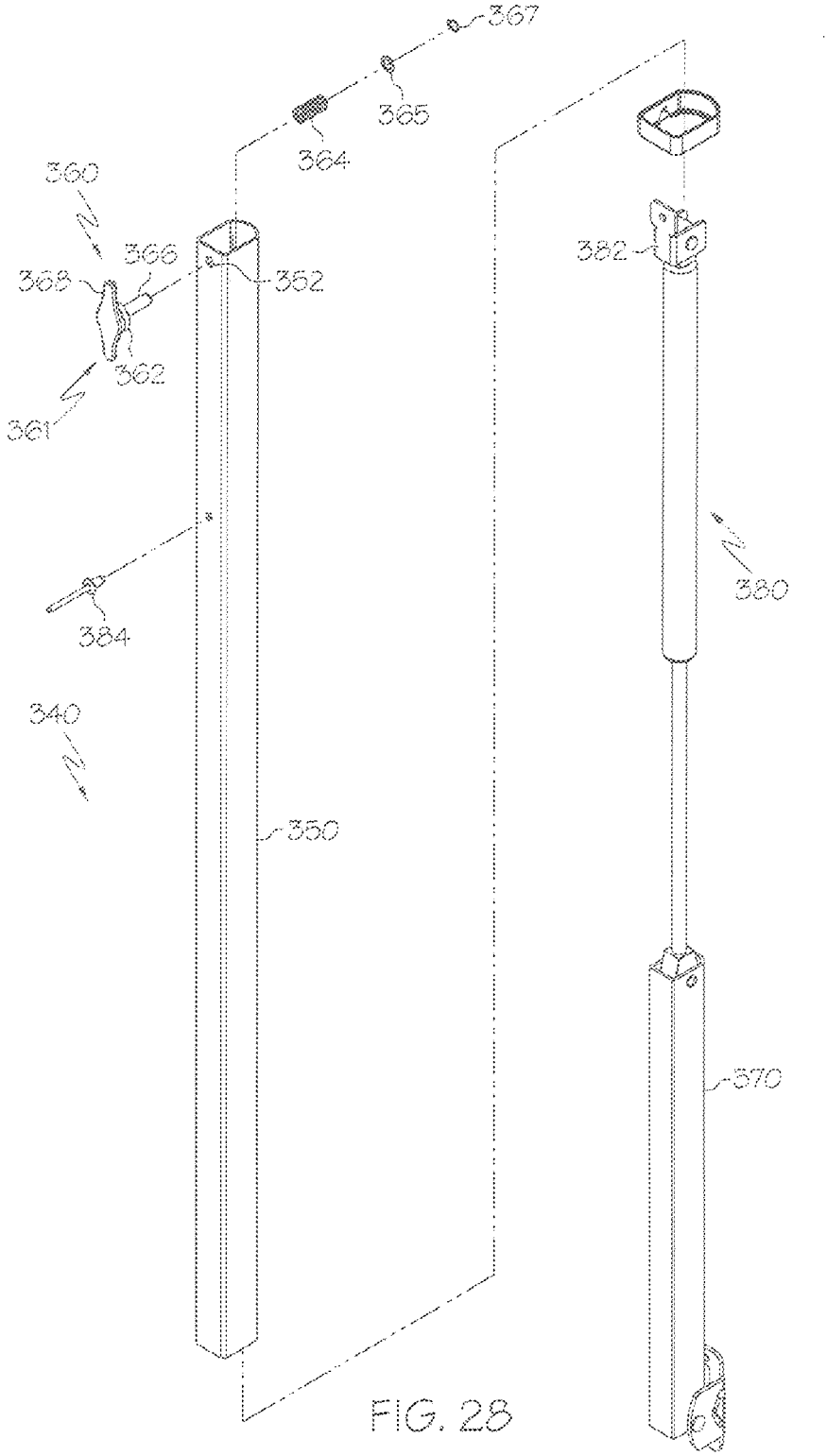
FIG. 28 is a partial exploded view of a second segment and third segment of the second support leg of FIG. 26.

The first segment, second segment and/or locking device may comprise a wide range of structures to achieve incremental length adjustment. Moreover, different or substantially similar structural arrangements between the support legs may be provided to achieve incremental length adjustment. As shown, for example, each first segment 240, 340 can include an elongated slot 242, 342 with a slot width (w), and a plurality of enlarged openings 244, 344 spaced in series along the slot 242, 342 and in communication with the slot 242, 342. As shown, the enlarged openings 244, 344 each include a dimension (d) that is greater than the slot width (w). FIG. 28 illustrates and exploded view of one example of a locking device 360. Only one locking device will be described since it is understood that the locking device 360 of the second support leg can be similar or identical to the locking device 260 of the first support leg. With reference to FIG. 28, the locking device 360 can include a pull member 361 with a handle 368, a stop element 362 attached to the handle 368 and a device link 366 extending from the stop element 362. The stop element 362 can have a shape corresponding to the shape of the enlarged openings 344 of the first segment 340 and the device link 366 can be configured to extend through the slot 342 of the first segment 340. A third biasing member 364 can be configured to urge the stop element 362 into a locking position. To assemble the pull member 361 to the second segment 350, the device link 366 is inserted through an aperture 352 of the second segment 350. The third biasing member 364, such as a compression coil spring, may then be inserted over the device link 366 and precompressed. A press washer 365 can then be inserted over the device link 366 and a third fastener 367, such as a clip, can be received within a groove in the end of the device link 366 to maintain the third biasing member 364 in a precompressed condition. Therefore, it will be appreciated, that the third biasing member 364 will be effective to bias the pull member 361 towards the second segment 350.

Referencing FIG. 26, the second segment 350 may be telescopingly received within the first segment 340. A locking element 354 may then be attached to an end 341 of the first segment 340 to prevent removal of the second segment 350 from telescoping engagement with the first segment 340. In order to adjust the length of the second support leg 330, the handle 368 may be pulled outward against the bias of the third biasing member 364 such that the stop element 362 is pulled out of engagement with an enlarged opening 344. The user continues to pull the handle 368 outward and telescopingly adjusts the second segment 350 with respect to the first segment 340. As the segments 340, 350 are moved relative to one another, the device link 366 freely travels within the elongated slot 342. Once the user obtains a length within the desired range, the handle is released. The third biasing member 364 then pulls the pull member such that the stop element 362 is urged against an outside of the slot 342 or within one of the enlarged openings 344. If the stop element is urged against the outside of the slot 342 the user then makes a slight adjustment of the relative position between the segments until the stop element 362 is aligned with an enlarged opening 344. Once aligned, the third biasing member 364 automatically pulls the stop element 362 into the enlarged opening 344 to lock the second support leg 330 at the selected incremental length. A similar procedure may also be carried out with the first support leg 230 such that identical lengths may be achieved.

Figure 29:
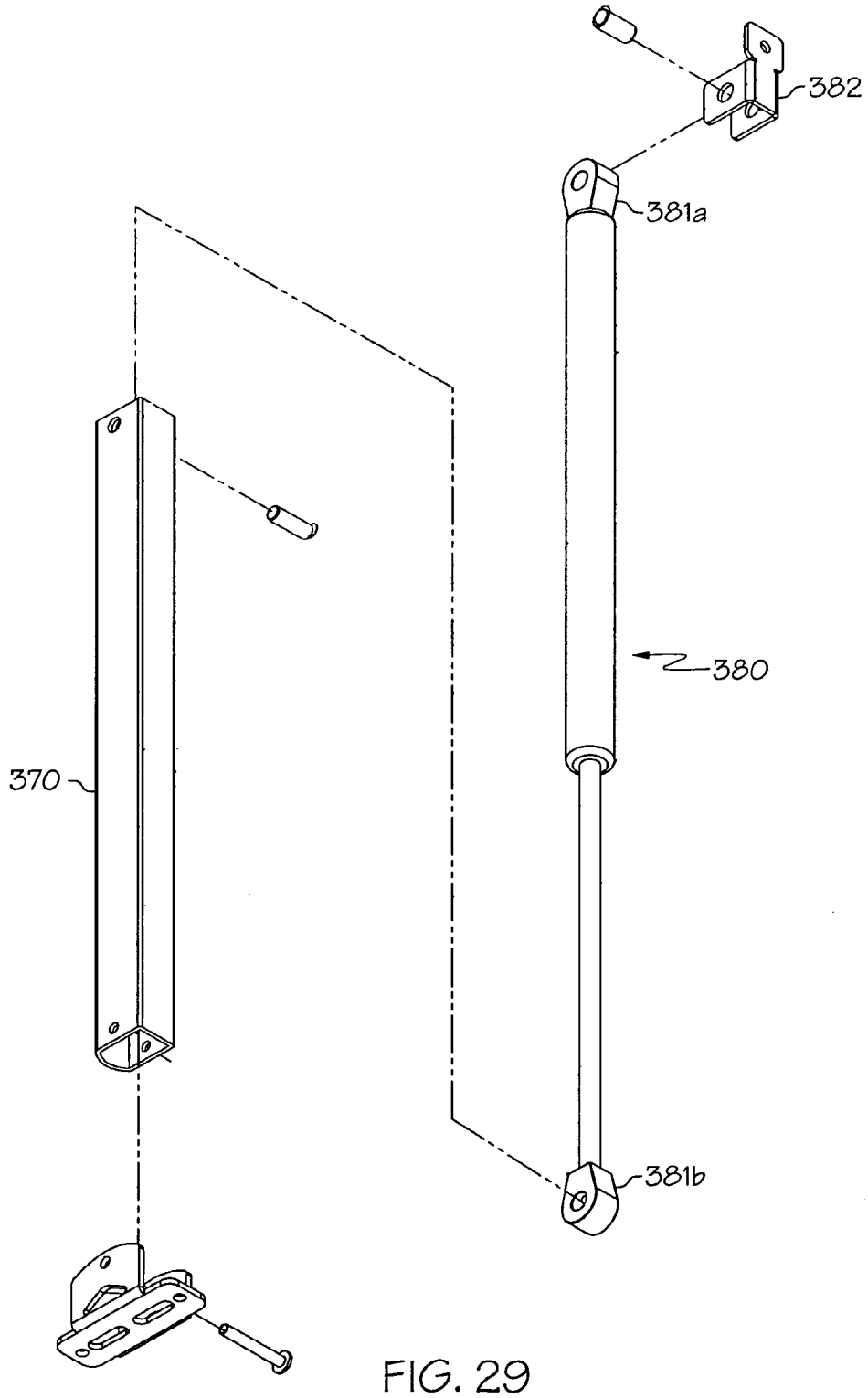
FIG. 29 is an exploded view of the third segment of the second support leg of FIG. 28.

As shown in FIGS. 26, 28 and 29, the second support leg 330 can also include a third segment 370 a fourth biasing member 380 configured to bias the third segment 370 to an extended position with respect to the second segment 350. As shown in FIG. 29, a second mounting bracket 382 may be attached to a first end 381*a* of the fourth biasing member 380 and a second end 381*b* of the fourth biasing member 380 may be attached to an end of the third segment 370. The second mounting bracket 382, together with the first end 381*a* of the fourth biasing member 380 may then be inserted within the second segment 350. A fourth fastener 384, such as a rivet, may then be used to attach the second mounting bracket 382 to the second segment 350. The biasing member can comprise a wide range of devices. As illustrated, the fourth biasing member 380 comprises a gas spring although other devices may be used in further examples.

Figure 30:
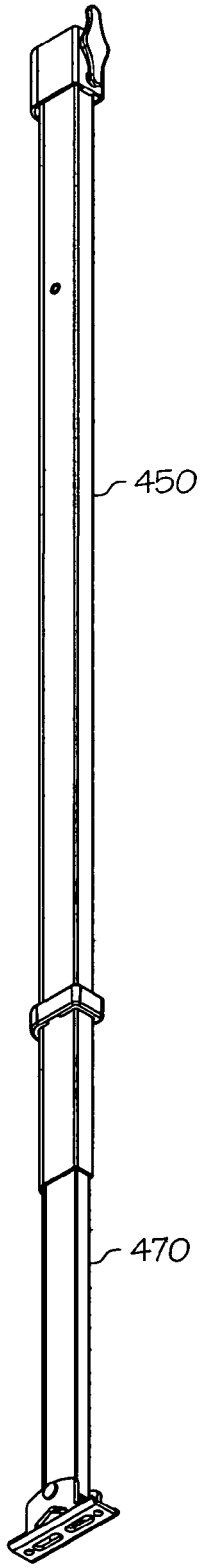
FIG. 30 a perspective view illustrating the second and third segment of another example of a second support leg incorporating aspects of the present invention.
Figure 31:
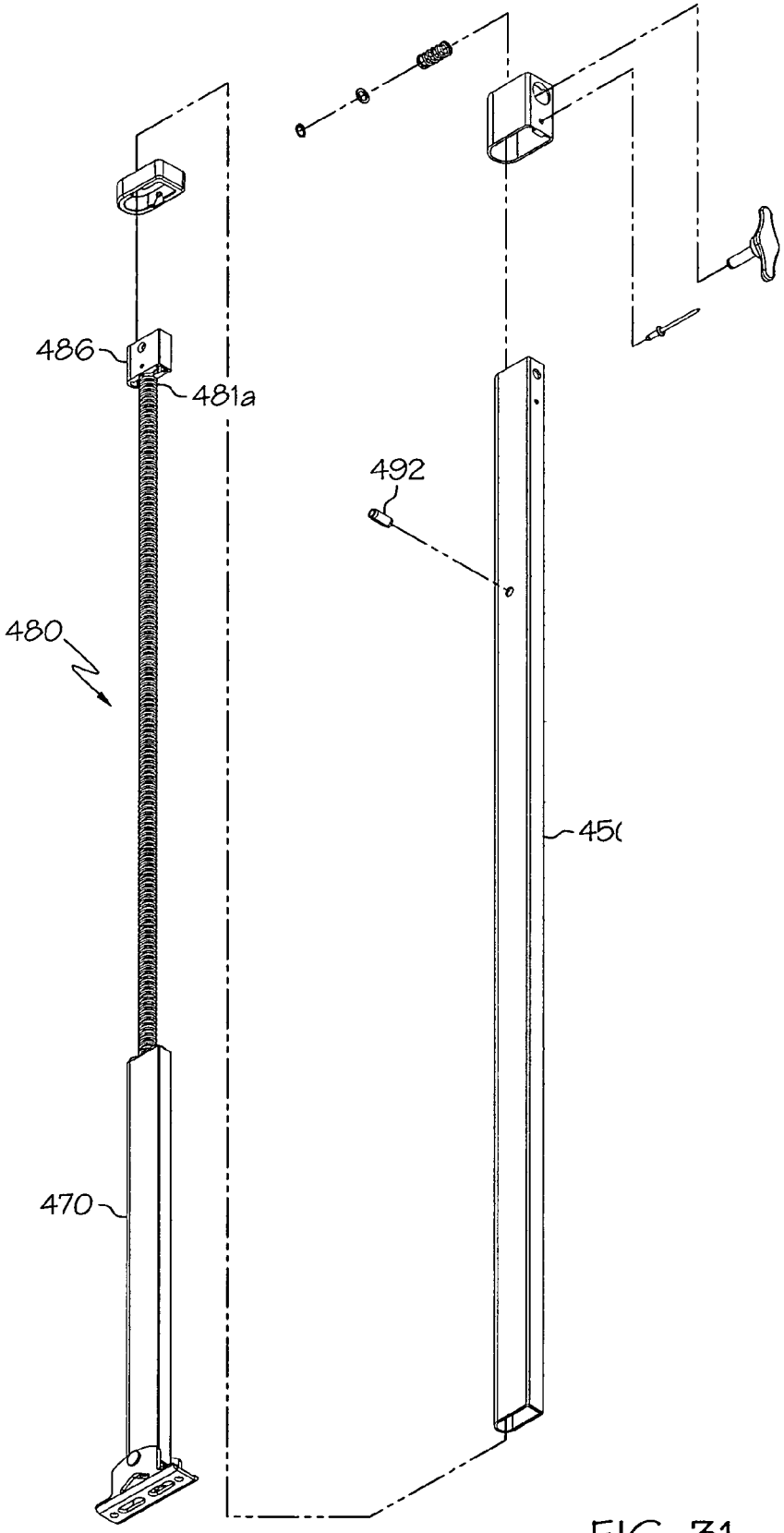
FIG. 31 is a partial exploded view of the second and third segment of the second support leg of FIG. 30.
Figure 32:
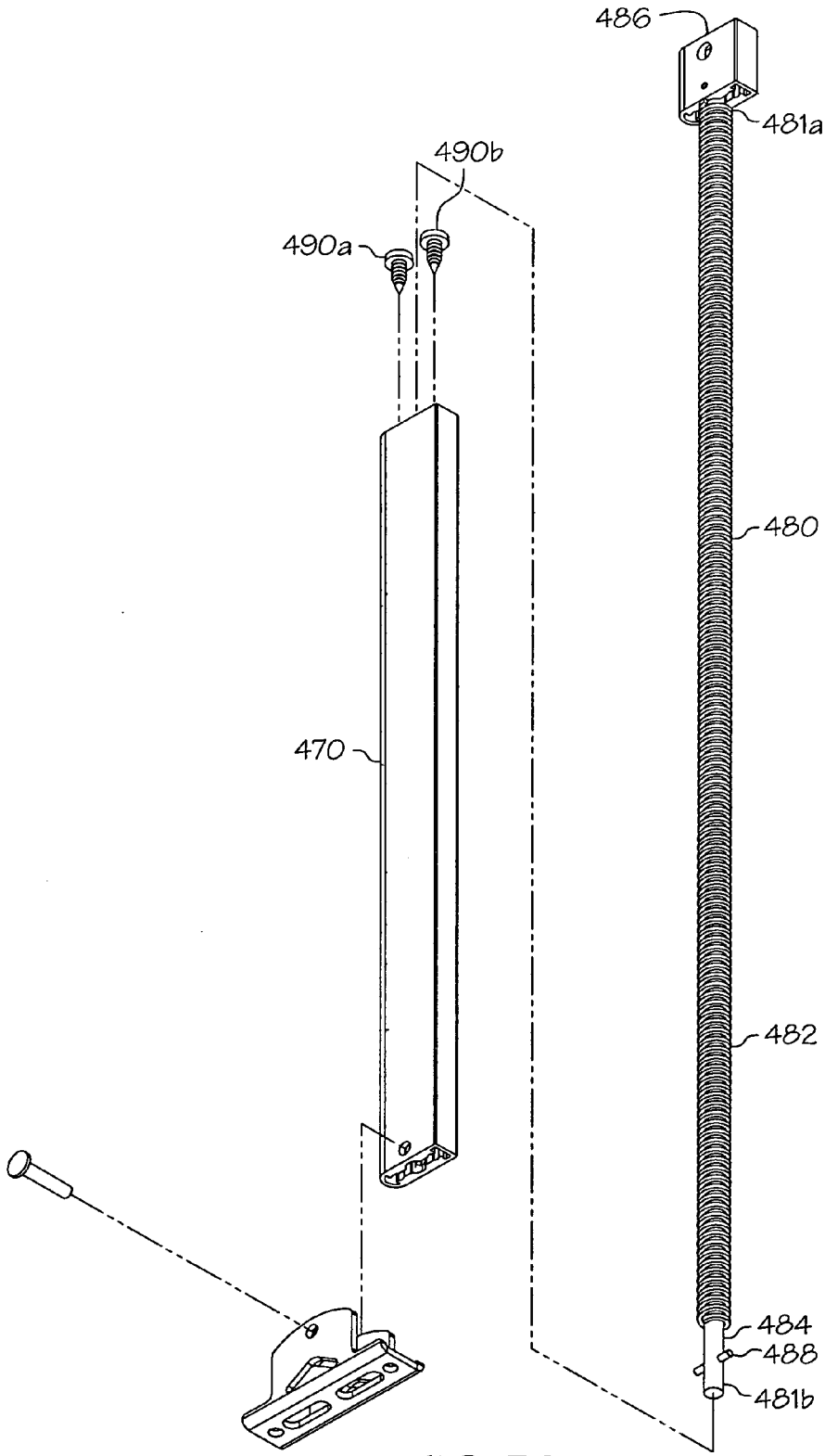
FIG. 32 is an exploded view of the third segment of the second support leg of FIG. 31.

FIGS. 30-32 illustrate another example of a second and third segment 450, 470. A fifth biasing member 480 is provided that comprises a compression spring 482 mounted about a rod 484. The fifth biasing member 480 is configured to bias the third segment 470 to an extended position with respect to the second segment 450. As shown in FIGS. 31 and 32, a third mounting bracket 486 may be attached to a first end 481*a* of the fifth biasing member 480 and a second end 481*b* of the fifth biasing member 480 may be attached trapped within the third segment 470. For example, a cross member 488 may be received within a lateral slot in the end of the third segment 470 and a pair of screws 490*a*, 490*b* may trap the cross member 488 within the third segment 470. As shown in FIG. 31, the third mounting bracket 486 may be inserted into an interior area of the second segment 450 and fastened to the second segment 450, for example, with a second rivet 492 or other fastener.

Figure 2A:
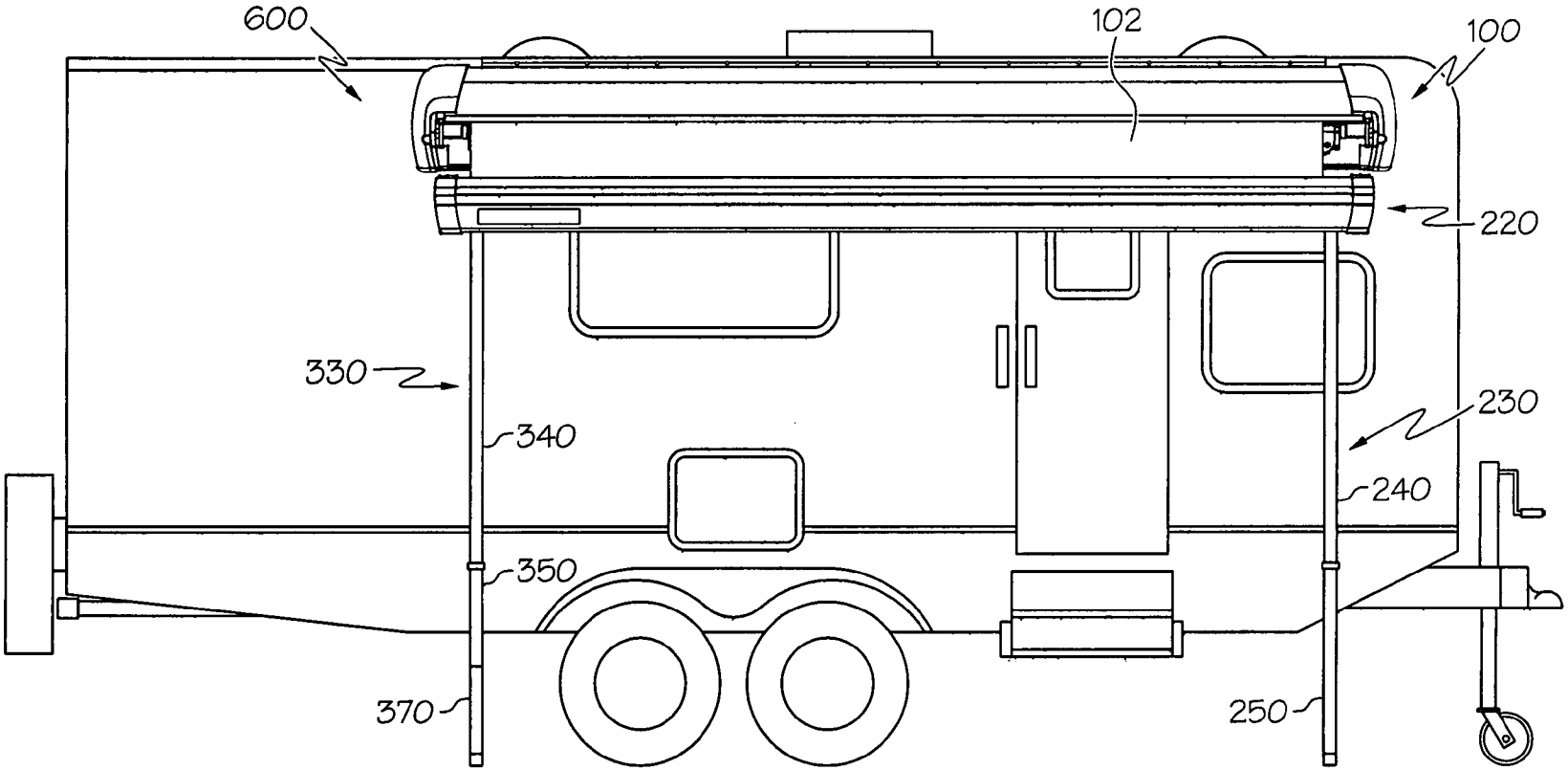
FIG. 2A is a front view of the awning assembly mounted to the support structure of FIG. 1.
Figure 2B:
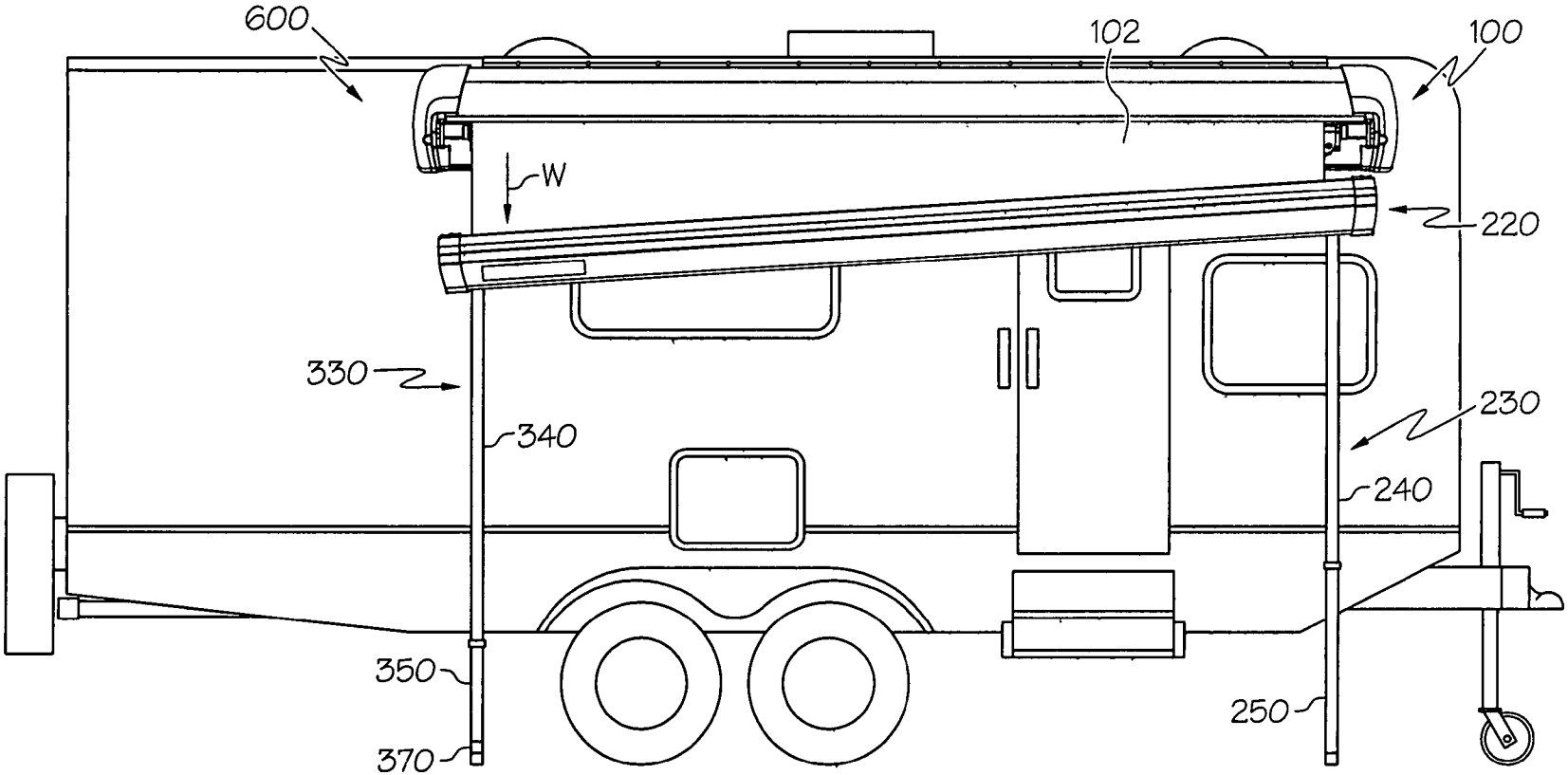
FIG. 2B is the front view of the awning assembly of FIG. 2A in an example rain dump orientation.

A method of using the support legs 230, 330 will be described with respect to FIGS. 2A and 2B. As previously described, the first and second support legs both provide for incremental adjustment such that the length of each leg may be set at substantially identical lengths to provide a substantially level lead rail 220 as shown in FIG. 2A. Moreover, the second support leg 330 can include the third segment 370 and fourth biasing member 380. The second support leg 330 allows the awning assembly to be incrementally adjusted as well as provide for a shed function if a predetermined weight (W) is experienced. As shown in FIG. 2B, if a predetermined weight (W) is positioned on a portion of the flexible awning material 102, the fourth biasing member 380 is configured to permit movement of the third segment 370 with respect to the second segment 350 to shed weight from the awning material 102 after which the fourth biasing member 380 again biases the third segment 370 to the extended position with respect to the second segment 350.

Operation of the awning assembly 100 will be described. From a fully retracted position, a user may operate a control to begin deployment of the awning assembly 100. During deployment, the arm assemblies 110*a*, 110*b* force the lead rail 220 to begin moving away from the back cover 400 wherein the flexible awning material 102 begins to unroll from the roller tube 410. The motor within the roller tube 410 can act as a braking mechanism during deployment to prevent the arm assemblies 110*a*, 110*b* from extending the lead rail 220 too quickly. A limit switch can be activated to indicate the fully deployed position wherein the motor prevents further movement of the lead rail 220 with respect to the back cover 400. Once deployed, each support leg 230, 330 may be deployed from the lead rail 220 and pivoted down. The foot of each support leg can be engaged with a ground surface or the foot can be attached to a side of the support structure 600. The 368 handle of each locking device 260, 360 may be pulled to release the stop element 362 from the respective enlarged opening 344 to adjust the overall length of the support legs. Once the desired length is achieved, the pull handle 368 may be released to allow the stop element 362 to be pulled back into the appropriate enlarged opening 344.

In order to retract the awning assembly 100, the support legs 230, 330 are pivoted back up and stored with respect to the lead rail 220. Next, a user interfaces with a control to cause the motor within the roller tube 410 to begin rolling the awning material 102 back on the roller tube 410. As the roller tube 410 pulls on the awning material 102, the lead rail 220 begins moving back towards the back cover 400 against the bias of the arm assemblies 110*a*, 110*b*. A triggering mechanism can be provided to turn off the motor once the fully retracted position is achieved. The triggering mechanism may comprise, for example, a limit switch or a controlled response to a predetermined change in voltage or current supplying electricity to the motor due to an overload condition of the motor.

From the above description of the invention, those skilled in the art will perceive improvements, changes and modifications. Such improvements, changes and modifications within the skill of the art are intended to be covered by the appended claims.

What is claimed:

1. An awning assembly for mounting to a support structure comprising:

an arm assembly;

a mounting bracket configured to mount to a support structure;

a link member pivotally attached between the arm assembly and the mounting bracket, wherein the arm assembly is configured to pivot with respect to the link member about a first pivot axis and the link member is configured to pivot with respect to the mounting bracket about a second pivot axis;

a compressible biasing member configured to resist rotation of the link member with respect to the mounting bracket about the second pivot axis; and an adjustment device configured to adjust the compression of the biasing member by threadably, rotatably engaging the link member and engaging the biasing member, wherein the adjustment device is secured at least partially within the link member.

2. The awning assembly of claim 1, wherein the adjustment device comprises an adjustment screw, wherein the adjustment screw is configured to engage an end of the biasing member.

3. The awning assembly of claim 1, further comprising a stop device configured to provide a limit to a pivoting movement of the link member with respect to the bracket about the second pivot axis.

4. The awning assembly of claim 1, wherein the second axis extends in a direction that is substantially perpendicular to a direction of the first axis.

5. An awning assembly for mounting to a support structure comprising:

an arm assembly including a first end portion and a second end portion, wherein the first end portion is configured for mounting with respect to a support structure;

a lead rail mounted with respect to the second end portion of the arm assembly, wherein the arm assembly is configured to support the lead rail with respect to the support structure;

a support leg; and a pivot assembly connecting the support leg to the lead rail, the pivot assembly including a pivot bracket attached to the lead rail, a pivot arm pivotally attached to the support leg to permit the support leg to pivot about a first axis extending in a first direction, a pivot link pivotally attaching the pivot arm to the pivot bracket, wherein the pivot arm is configured to pivot with respect to the pivot link about a second axis extending in a second direction that is substantially perpendicular to the first direction and coaxial with the pivot arm, the pivot link is further configured to pivot with respect to the pivot bracket about a third axis extending in a third direction that is substantially perpendicular to the first direction and the second direction wherein the third axis intersects the second axis, wherein the pivot arm is configured to pivot between a stowed position, in which the pivot arm is configured to be substantially parallel to the lead rail, and a deployed position, in which the pivot arm is configured to be substantially perpendicular to the lead rail, and a first stop member configured to limit the extent to which the pivot link can pivot with respect to the pivot bracket about the third axis;

wherein the pivot bracket includes a pivot bore extending through the pivot bracket coaxially with the third axis, further wherein the pivot link is adapted to coaxially extend at least partially through the pivot bore.

6. The awning assembly of claim 5, wherein the first stop member together with the lead rail provides at least about a 90° limit to which the pivot link can pivot with respect to the pivot bracket.

7. The awning assembly of claim 5, further comprising a second stop member configured to limit the extent to which the pivot arm can pivot with respect to the pivot link.

8. The awning assembly of claim 7, wherein the second stop member provides at least about a 90° limit to which the pivot arm can pivot with respect to the pivot link.

9. An awning assembly for mounting to a support structure comprising:

an arm assembly including a first end portion and a second end portion, wherein the first end portion is configured for mounting with respect to a support structure;

a lead rail mounted with respect to the second end portion of the arm assembly, wherein the arm assembly is configured to support the lead rail with respect to the support structure;

a support leg; and a pivot assembly connecting the support leg to the lead rail, the pivot assembly including a pivot bracket attached to the lead rail, a pivot arm pivotally attached to the support leg to permit the support leg to pivot about a first axis extending in a first direction, a pivot link pivotally attaching the pivot arm to the pivot bracket, wherein the pivot arm is configured to pivot with respect to the pivot link about a second axis extending in a second direction that is substantially perpendicular to the first direction and coaxial with the pivot arm, the pivot link is further configured to pivot with respect to the pivot bracket about a third axis extending in a third direction that is substantially perpendicular to the first direction and the second direction wherein the third axis intersects the second axis, wherein the pivot arm is configured to pivot between a stowed position, in which the pivot arm is configured to be substantially parallel to the lead rail, and a deployed position, in which the pivot arm is configured to be substantially perpendicular to the lead rail, and a first stop member configured to limit the extent to which the pivot link can pivot with respect to the pivot bracket and a second stop member configured to limit the extent to which the pivot arm can pivot with respect to the pivot link by engaging with the pivot link, wherein the second stop member is positioned adjacent to the pivot arm and wherein the pivot bracket includes a pivot bore extending through the pivot bracket coaxially with the third axis, further wherein the pivot link is adapted to coaxially extend at least partially through the pivot bore.

10. The awning assembly of claim 9, wherein the second stop member provides at least about a 90° limit to which the pivot arm can pivot with respect to the pivot link.

11. An awning assembly for mounting to a support structure comprising:

an arm assembly including a first end portion and a second end portion, wherein the first end portion is configured for mounting with respect to a support structure;

a lead rail mounted with respect to the second end portion of the arm assembly, wherein the arm assembly is configured to support the lead rail with respect to a support structure; and a first and second support leg that each include a first segment attached to the lead rail, a second segment attached to the first segment, and a slidable locking device biased towards the second segment and outwardly pullable in a direction perpendicular to a longitudinal axis of the second segment, the slidable locking device extending partially but not completely through the second segment, and configured to selectively lock the second segment with respect to an elongated slot including a slot width, and a plurality of enlarged openings spaced in series along the slot in the first segment in a selected one of a plurality of alternate relative positions to allow the support legs to be selectively locked in one of a plurality of predetermined incremental lengths.

12. The awning assembly of claim 11, wherein the locking device comprises a stop element that is urged into a locking position by a biasing member.

13. The awning assembly of claim 11, wherein the first segment includes the plurality of enlarged openings spaced in series along the slot and in communication with the slot, wherein the enlarged openings each include a dimension that is greater than the slot width wherein the locking device is configured to selectively engage and outwardly, pullably disengage the enlarged openings.

14. The awning assembly of claim 13, wherein the locking device comprises a stop element configured to be received in a selected one of the enlarged openings to selectively lock the second segment with respect to the first segment in the selected one of the plurality of alternate relative positions.

15. The awning assembly of claim 14, wherein the second segment is telescopingly received in the first segment and the locking device is attached to the second segment by a device link configured to extend through the slot of the first segment.

16. The awning assembly of claim 11, further comprising a sheet of flexible awning material, wherein the second support leg further includes a third segment and a biasing member configured to bias the third segment to an extended position with respect to the second segment, wherein if a predetermined weight is positioned on a portion of the flexible awning material, the biasing member is configured to permit movement of the third segment with respect to the second segment to shed weight from the awning material after which the biasing member again biases the third segment to the extended position with respect to the second segment.

* * * * *